US012595603B2

(12) United States Patent
Malmqvist

(10) Patent No.: US 12,595,603 B2
(45) Date of Patent: Apr. 7, 2026

(54) AIR-LAID BLANK, A METHOD OF PRODUCING AN AIR-LAID BLANK AND A METHOD OF PRODUCING A THREE DIMENSIONAL PRODUCT FROM SAID AIR-LAID BLANK

(71) Applicant: Stora Enso OYJ, Helsinki (FI)

(72) Inventor: Martin Malmqvist, Halmstad (SE)

(73) Assignee: Stora Enso OYJ, Helsinki (FI)

( * ) Notice: Subject to any disclaimer, the term of this patent is extended or adjusted under 35 U.S.C. 154(b) by 300 days.

(21) Appl. No.: 18/042,652

(22) PCT Filed: Jul. 9, 2021

(86) PCT No.: PCT/IB2021/056175
§ 371 (c)(1),
(2) Date: Feb. 23, 2023

(87) PCT Pub. No.: WO2022/043779
PCT Pub. Date: Mar. 3, 2022

(65) Prior Publication Data

US 2023/0332341 A1 Oct. 19, 2023

(30) Foreign Application Priority Data

Aug. 24, 2020 (SE) ..... 2050974-1

(51) Int. Cl.
*D04H 1/732* (2012.01)
*A61F 13/15* (2006.01)
(Continued)

(52) U.S. Cl.
CPC ..... *D04H 1/732* (2013.01); *D04H 1/26* (2013.01); *D04H 1/5418* (2020.05); *D04H 1/587* (2013.01); *D04H 1/60* (2013.01)

(58) Field of Classification Search
CPC ..... A61F 2013/1543; A61F 2013/15439
See application file for complete search history.

(56) References Cited

U.S. PATENT DOCUMENTS 3,575,749 A 4/1971 Kroyer
4,093,765 A * 6/1978 Schmidt ..... A61L 15/28 604/382

(Continued)

FOREIGN PATENT DOCUMENTS

EP 1446286 A1 8/2004
GB 1203682 A * 9/1970 ..... A61F 13/535

(Continued)

OTHER PUBLICATIONS

International Search Report from corresponding PCT application No. PCT/IB2021/056175 mailed on Oct. 25, 2021.

*Primary Examiner* — Frank J Vineis
*Assistant Examiner* — Nicole T Gugliotta
(74) *Attorney, Agent, or Firm* — Greer, Burns & Crain Ltd.

(57) ABSTRACT

An air-laid blank (10) comprises natural fibers at a concentration of at least 70% by weight of the air-laid blank (10) and a thermoplastic polymer binder at a concentration selected within an interval of from 2.5 up to 30% by weight of the air-laid blank (10). The air-laid blank (10) has an average density and a portion (11) of the air-laid blank (10) has a density different from the average density. The air-laid blank (10) is produced by modifying the air-permeability of a portion (121) of an air-permeable collector (120) to form a portion (11) of the air-laid blank (10) having a density from the average density. The air-laid blank (10) has two parallel planar major surfaces (12, 14).

15 Claims, 13 Drawing Sheets

(51) Int. Cl.

| | |
|---|---|
| ***B32B 5/14*** | (2006.01) |
| ***D04H 1/22*** | (2006.01) |
| ***D04H 1/24*** | (2006.01) |
| ***D04H 1/26*** | (2012.01) |
| ***D04H 1/541*** | (2012.01) |
| ***D04H 1/542*** | (2012.01) |
| ***D04H 1/587*** | (2012.01) |
| ***D04H 1/60*** | (2006.01) |
| ***D04H 1/70*** | (2012.01) |

(56) References Cited

U.S. PATENT DOCUMENTS

| | | | | |
|---|---|---|---|---|
| 4,418,031 | A * | 11/1983 | Doerer | B29C 33/18 428/326 |
| 4,971,742 | A | 11/1990 | Brooks et al. | |
| 5,843,559 | A | 12/1998 | Cadieux et al. | |
| 5,961,757 | A | 10/1999 | Trombetta et al. | |
| 2003/0036741 | A1 | 2/2003 | Abba et al. | |
| 2008/0318004 | A1 | 12/2008 | Ruhe et al. | |
| 2010/0190020 | A1 | 7/2010 | Frederiksen et al. | |
| 2013/0108831 | A1 | 5/2013 | Wu et al. | |
| 2013/0146061 | A1 | 6/2013 | Tushaus et al. | |
| 2020/0189242 | A1 * | 6/2020 | Cai | E04F 15/203 |
| 2023/0249889 | A1 * | 8/2023 | Törnblom | B65D 81/022 220/592.25 |
| 2023/0249890 | A1 * | 8/2023 | Törnblom | D21J 1/08 220/592.25 |

FOREIGN PATENT DOCUMENTS

| | | | | |
|---|---|---|---|---|
| WO | 0154641 | A1 | 8/2001 | |
| WO | 0242070 | A1 | 5/2002 | |
| WO | WO-2019014096 | A1 * | 1/2019 | B32B 1/00 |

* cited by examiner

AIR-LAID BLANK, A METHOD OF PRODUCING AN AIR-LAID BLANK AND A METHOD OF PRODUCING A THREE DIMENSIONAL PRODUCT FROM SAID AIR-LAID BLANK

This application is a U.S. National Phase under 35 U.S.C. § 371 of International Application No. PCT/IB2021/056175 filed Jul. 9, 2021, which claims priority under 35 U.S.C. §§ 119 and 365 to Swedish Application No. 2050974-1 filed Aug. 24, 2020.

TECHNICAL FIELD

The present embodiments generally relate to air-laid blanks and methods of producing such air-laid blanks and three dimensional (3D) shaped products.

BACKGROUND

With growing awareness for the environment and humanly induced climate change, the use of single use plastic items and products has come more and more into question. However, despite this concern the use of these items and products has grown vastly with new trends in lifestyles and consumer habits of the last decade. One reason for this is that more and more goods are transported around the globe and these goods need protection against impact or shock and/or extreme temperatures. A common way of protecting the goods is to include cushioning and/or insulating elements or products, such as inserts of suitable form into the packaging. These can be made from different materials but are typically made from a foamed polymer, of which expanded polystyrene (EPS) is by far cheapest and most common. In some cases, the entire packaging can be made out of EPS. One example is transport boxes for food that have to be kept within specified temperature intervals, such as cold food, e.g., fish, or hot food, e.g., ready meals. EPS is, however, one of the most questioned plastic materials and many brand owners are looking for more sustainable solutions for these packaging applications. Many countries have also begun to take legislative actions against single use plastic items and products, which increases the pressure to find alternative solutions.

More sustainable alternatives to polymer products exist today, such as inserts made by a process known as pulp molding, where a fiber suspension is sucked against a wire mold by vacuum. Another technique for forming such inserts are described in U.S. patent application no. 2010/0190020 and European patent no. 1 446 286, which both concern hot pressing of porous fiber mats produced by the process called air-laying into 3D structures with matched rigid molds or by membrane molding.

The above exemplified methods, however, give products with a limited ability for shock protection and thermal insulation. There is therefore a demand in the market for 3D shaped products for cushioning and/or thermal insulation of packaged goods and that can be manufactured using more environmentally friendly materials than EPS.

SUMMARY

It is an objective to provide air-laid blanks that can be used to produce 3D shaped products for cushioning and/or thermal insulation of packaged goods.

This and other objectives are met by embodiments of the present invention.

The present invention is defined in the independent claims. Further embodiments of the invention are defined in the dependent claims.

An aspect of the invention relates to an air-laid blank comprising natural fibers at a concentration of at least 70% by weight of the air-laid blank and a thermoplastic polymer binder at a concentration selected within an interval of from 2.5 up to 30% by weight of the air-laid blank. The air-laid blank has an average density and a portion of the air-laid blank has a density different from the average density. The air-laid blank has two parallel planar major surfaces.

Another aspect of the invention relates to a method of producing an air-laid blank. The method comprises introducing natural fibers and a thermoplastic polymer binder and/or a mixture of the natural fibers and the thermoplastic polymer binder into an upper end of a forming head. The method also comprises transporting the natural fibers and the thermoplastic polymer binder and/or the mixture to a lower end of the forming head by vacuum applied over an air-permeable collector arranged in connection with the lower end of the forming head. The method further comprises capturing the natural fibers and the thermoplastic polymer binder and/or the mixture on the air-permeable collector. The method additionally comprises heating the natural fibers and the thermoplastic polymer binder and/or the mixture to form an air-laid blank. The air-laid blank comprises the natural fibers at a concentration of at least 70% by weight of the air-laid blank and the thermoplastic polymer binder at a concentration selected within an interval of from 2.5 up to 30% by weight of the air-laid blank. The air-permeable collector has an average air-permeability. A portion of the air-permeable collector has an air-permeability different from the average air-permeability and/or an object is positioned on a portion of the air-permeable collector. The portion of the air-permeable collector with the object positioned thereon has an air-permeability different from the average air-permeability. The air-laid blank has an average density and a portion of the air-laid blank aligned with the portion of the air-permeable collector has a density different from the average density. The air-laid blank has two parallel planar major surfaces.

A further aspect of the invention relates to a method of producing a 3D shaped product. The method comprising hot pressing of a male tool into an air-laid blank to form a 3D shaped product having a 3D shape at least partly defined by the male tool. The air-laid blank comprises natural fibers at a concentration of at least 70% by weight of the air-laid blank and a thermoplastic polymer binder at a concentration selected within an interval of from 2.5 up to 30% by weight of the air-laid blank. The air-laid blank has an average density and a portion of the air-laid blank has a density different from the average density. The male tool comprises a protrusion configured to be pressed into the air-laid blank and the protrusion is configured to be aligned with the portion of the air-laid blank having a density different from the average density of the air-laid blank during the hot pressing.

Yet another aspect of the invention relates to a method of producing an air-laid blank. The method comprises introducing natural fibers and a thermoplastic polymer binder and/or a mixture of the natural fibers and the thermoplastic polymer binder into an upper end of a forming head. The method also comprises transporting the natural fibers and the thermoplastic polymer binder and/or the mixture to a lower end of the forming head arranged in connection with a belt collector running between drive rollers. The method further comprises positioning a 3D object onto the belt collector and capturing the natural fibers and the thermoplastic polymer binder and/or the mixture on the belt collector. The method additionally comprises heating the natural fibers and the thermoplastic polymer binder and/or the mixture to form an air-laid blank. The air-laid blank comprises the natural fibers at a concentration of at least 70% by weight of the air-laid blank and the thermoplastic polymer binder at a concentration selected within an interval of from 2.5 up to 30% by weight of the air-laid blank. The air-laid blank has two parallel major surfaces and a thickness between the two parallel major surfaces. The 3D object defines an aperture in a first major surface of the two parallel major surfaces and a cavity in the air-laid blank.

The present invention relates to air-laid blanks that can be produced into 3D shaped products that are highly suitable for cushioning of packaged goods providing excellent shock absorbing and damping properties. The 3D shaped products also have thermally insulating properties and, therefore, they can be used for storage and/or transport of tempered, such as cold or hot, goods, such as provisions and foodstuff. The 3D shaped products suitable for cushioning and/or thermal protection are additionally made of environmentally friendly natural fibers in clear contrast to prior art foamed inserts made of polystyrene and other polymers.

BRIEF DESCRIPTION OF THE DRAWINGS

The embodiments, together with further objects and advantages thereof, may best be understood by making reference to the following description taken together with the accompanying drawings, in which.

DETAILED DESCRIPTION

Figure 1:
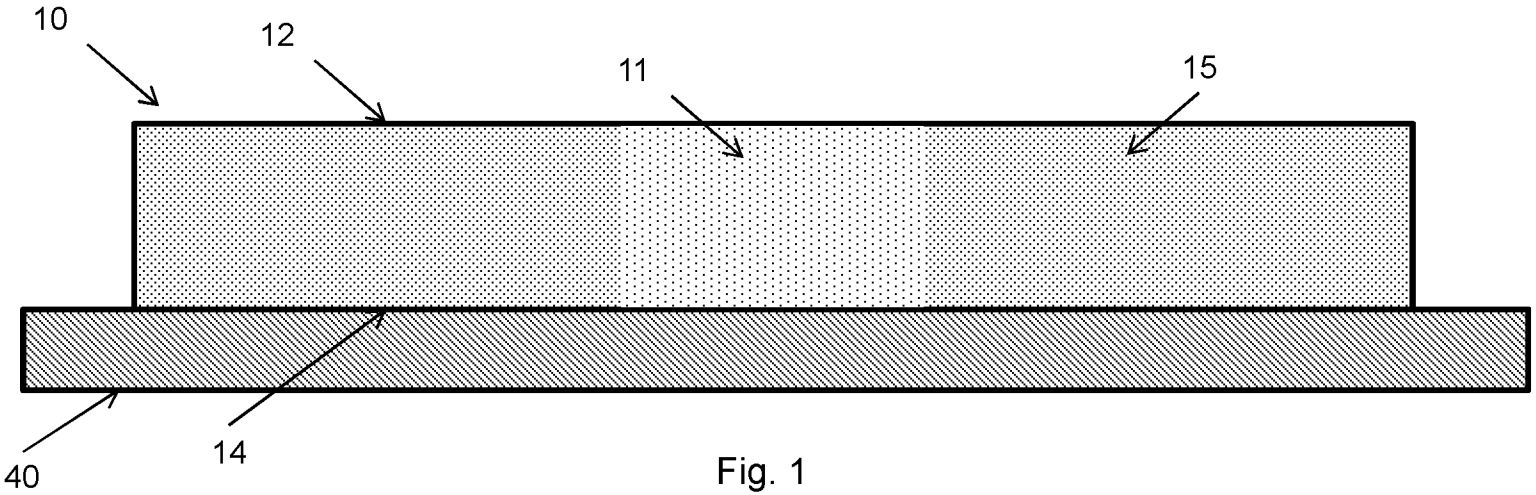
FIG. 1 is a cross sectional view of an air-laid blank according to an embodiment.

The present embodiments generally relate to air-laid blanks and methods of producing such air-laid blanks and three dimensional (3D) shaped products.

3D shaped products produced from air-laid blanks of the present embodiments are useful as environmentally more friendly replacements to corresponding 3D shaped products made of or from foamed polymers, for instance expanded polystyrene (EPS). More sustainable alternatives to polymer zo products have been proposed in U.S. patent application no. 2010/0190020 and European patent no. 1 446 286, which both concern hot pressing of porous fiber mats produced by the process called air-laying into 3D structures with matched rigid molds or by membrane molding. The 3D shaped products produced in the above mentioned documents are, however, dense with thin cross sections and have therefore limited shock absorbing or damping ability and comparatively poor thermal insulation.

The 3D shaped products produced in accordance with the present embodiments are formed by hot pressing of an air-laid blank comprising natural fibers and a thermoplastic polymer binder. An air-laid blank, sometimes also referred to as dry-laid blank, air-laid mat, dry-laid mat, air-laid web or dry-laid web, is formed by a process known as air-laying, in which the natural fibers and the thermoplastic polymer binder are mixed with air to form a porous fiber mixture deposited onto a support and consolidated or bonded by heating or thermoforming. This air-laid blank is characterized by being porous, having the character of an open cell foam and being produced in a so-called dry forming method, i.e., generally without addition of water. The air-laying process was initially described in U.S. Pat. No. 3,575,749. The air-laid blank may be in the form as produced in the air-laying process. Alternatively, the air-laid blank may be in an at least partly processed form, such as by being cut into a given form prior to hot pressing.

In clear contrast to U.S. patent application no. 2010/0190020 and European patent no. 1 446 286, the 3D shaped products of the present embodiments formed from air-laid blanks retain characteristics of the air-laid blanks even after hot pressing and, therefore, have excellent shock absorbing and thermally insulating properties. The 3D products could thereby be produced to have geometries, i.e., 3D shapes, suitable for protection of goods during transport and/or storage. For instance, the 3D shaped products may contain cavities designed to match the shape of goods to be protected. The preservation of the porous character of the air-laid blank starting material means that the 3D shaped products could be used to protect not only consumer goods and products but also heavy equipment against impact. Furthermore, the 3D shaped products produced in accordance with the present embodiments have improved thermally insulating properties as compared to compact and dense 3D shaped products with thin cross sections. This means that the 3D shaped products can also, or alternatively, be used for storage and/or transport of goods that need to be kept cold, such as cold provisions, or need to be kept hot or warm, such as ready meals.

Figure 2:
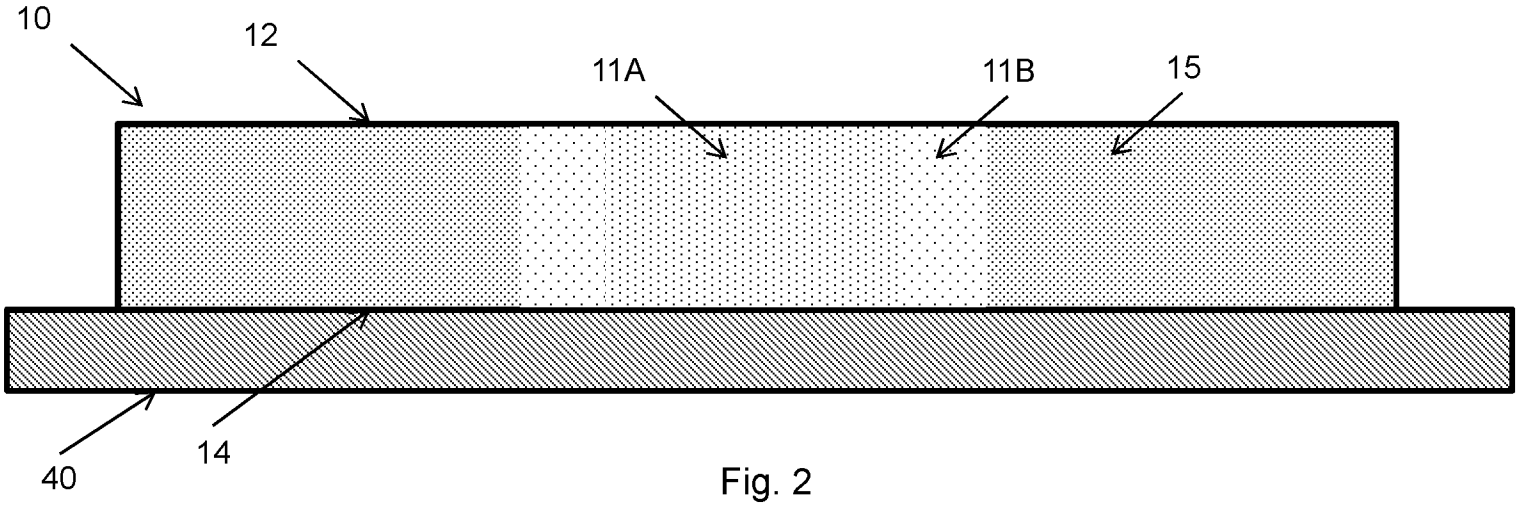
FIG. 2 is a cross sectional view of an air-laid blank according to another embodiment.
Figure 3:
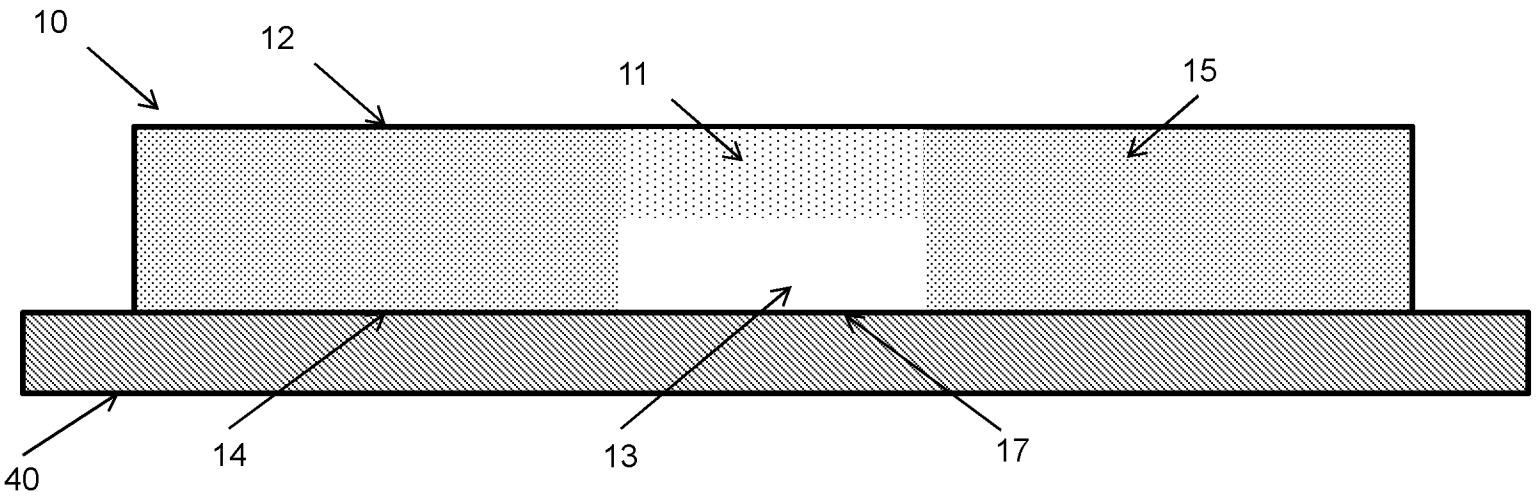
FIG. 3 is a cross sectional view of an air-laid blank according to a further embodiment.

An aspect of the invention relates to an air-laid blank 10, see FIGS. 1 to 3. The air-laid blank 10 comprises natural fibers at a concentration of at least 70% by weight of the air-laid blank 10 and a thermoplastic polymer binder at a concentration selected within an interval of from 2.5 up to 30% by weight of the air-laid blank 10. The air-laid blank 10 has an average density but a portion 11 of the air-laid blank has a density different from the average density. The air-laid blank 10 has two parallel planar major surfaces 12, 14.

Traditionally, air-laid blanks 10 are produced to form rather uniform and homogenous mixtures of natural fibers and thermoplastic polymer binder(s). Hence, these prior art air-laid blanks 10 have a substantially uniform density throughout the whole air-laid blank 10 and where this density depends on the natural fibers and the thermoplastic polymer binder and process parameters used in the air-laying process. The air-laying process used to produce or manufacture air-laid blanks 10 of the present embodiments, however, creates at least one portion 11 of the air-laid blank 10 that has a density that is different from the density of other parts 15 of the air-laid blank 10 and of the average density of the air-laid blank 10.

The average or mean density of the air-laid blank 10 as used herein represents the total mass of the air-laid blank 10 divided by the volume of the air-laid blank 10 excluding any cavities 13 in the air-laid blank 10 formed during the air-laying process as further described herein with reference to FIGS. 13 to 17. Correspondingly, the density of the portion 11 of the air-laid blank 10 represents the average or mean density of this portion 11 of the air-laid blank 10. The portion 11 of the air-laid blank 10 could, in an embodiment, have substantially uniform density that is different from the average density of the air-laid blank 10. However, the embodiments are not limited thereto. Hence, the portion 11 of the air-laid blank 10 does not necessary have to have uniform density, such as through the whole thickness of the air-laid blank 10. For instance, the density could increase or decrease when travelling through the thickness of the air-laid blank 10 from a first major surface 14 to a second major surface 12 of the air-laid blank 10, i.e., from one of the two parallel planar major surfaces 12, 14 to the other of the two parallel planar major surfaces. However, the average density of this portion 11 of the air-laid blank 10 is still different from the average density of the air-laid blank 10.

In an embodiment, the portion 11 of the air-laid blank 10 having a density that is different from the average density of the air-laid blank 10 has a density that is lower than the average density of the air-laid blank 10.

In an embodiment, the density of the portion 11 of the air-laid blank 10 is equal to or less than 95% of the average density, preferably equal to or less than 90%, equal to or less than 85%, equal to or less than 80% or equal to or less than 75% of the average density of the air-laid blank 10. In some applications, the density of the portion 11 of the air-laid blank 10 may be even lower, such as equal to or less than 70%, equal to or less than 65%, equal to or less than 60%, equal to or less than 55%, such as equal to or less than 50% of the average density of the air-laid blank 10.

In an embodiment, the average density of the air-laid blank 10 is selected within an interval of from 10 to 60 $kg/m^3$, preferably within an interval of from 15 to 60 $kg/m^3$, and more preferably within an interval of from 15 to 50 $kg/m^3$.

In an embodiment, the portion 11 of the air-laid blank 10 has a density selected within an interval of from 1 to 50 $kg/m^3$, preferably within an interval of from 2.5 to 40 $kg/m^3$ and more preferably within an interval of from 2.5 to 30 $kg/m^3$, such as within an interval of from 2.5 to 25 $kg/m^3$, preferably with the proviso that the density of the portion 11 of the air-laid blank 10 is lower than the average density of the air-laid blank 10.

Figure 8:
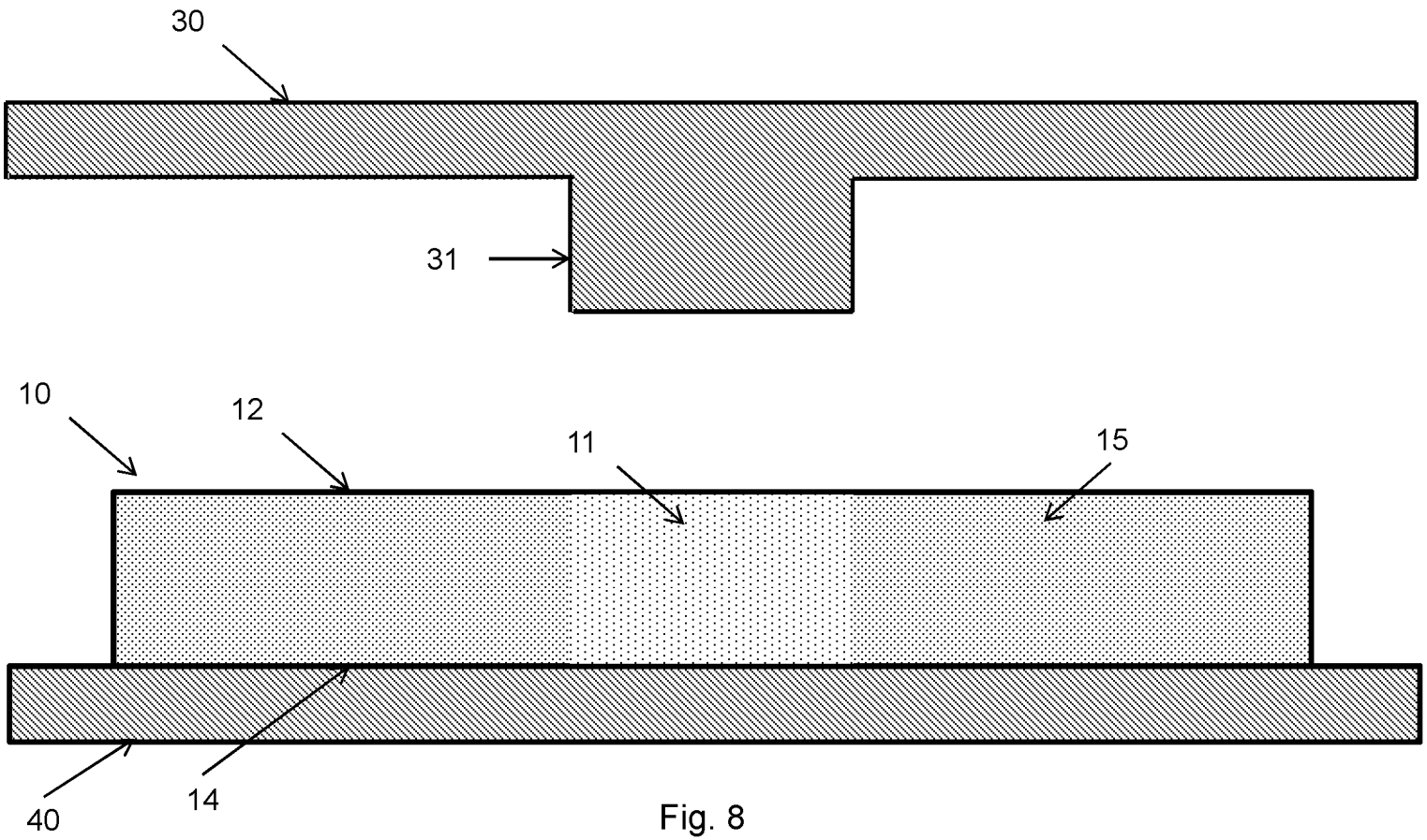
FIG. 8 schematically illustrates hot pressing of a male tool into the air-laid blank shown in FIG. 1.
Figure 9:
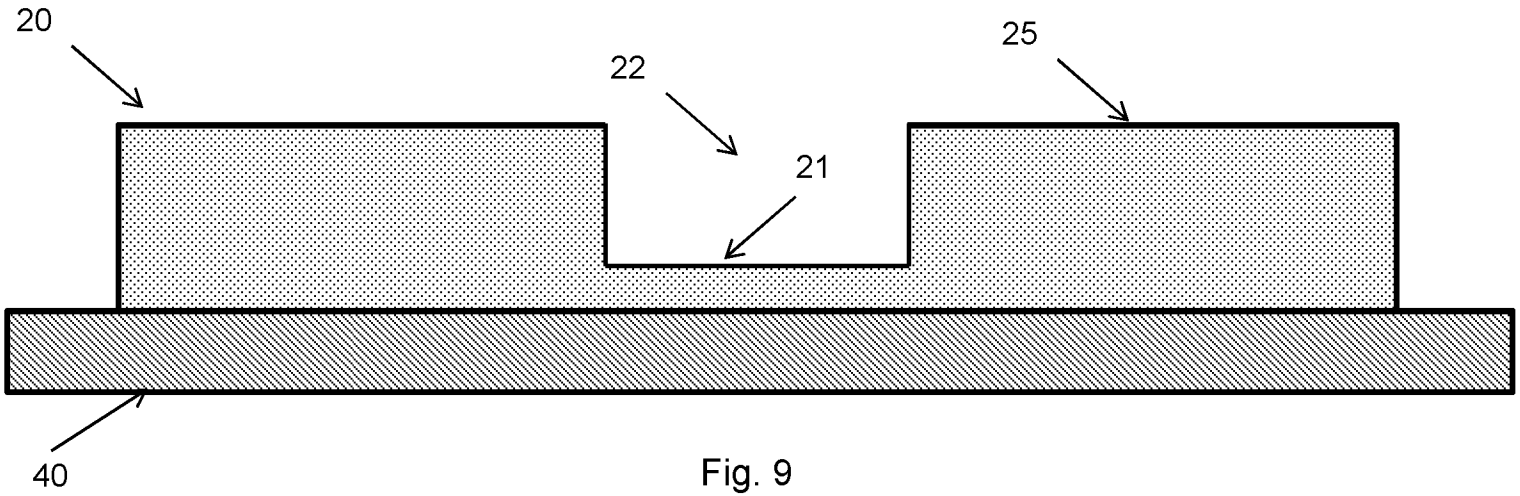
FIG. 9 is a cross sectional view of a 3D shaped product formed in the hot pressing of FIG. 8.
Figure 11:
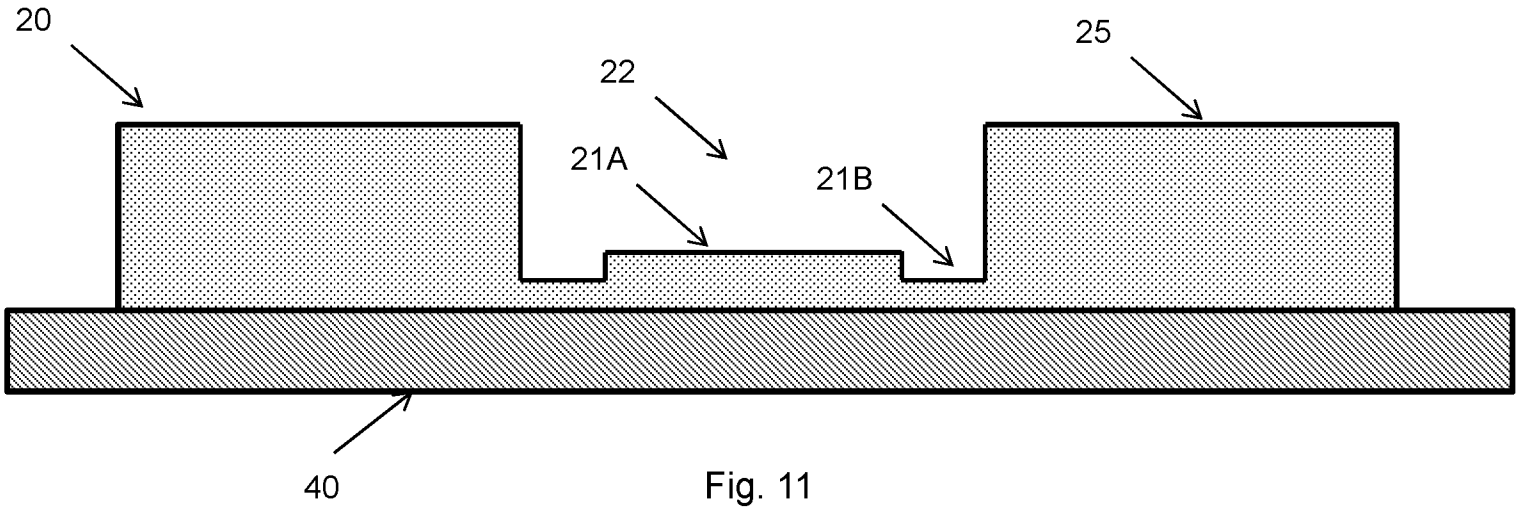
FIG. 11 is a cross sectional view of a 3D shaped product formed in the hot pressing of FIG. 10.

A 3D shaped product 20, see FIGS. 9 and 11, is formed from the air-laid blank 10 in a hot pressing process that involves pressing a male tool 30, see FIGS. 8 and 9, into the air-laid blank 10 or hot pressing the air-laid blank 10 between such a male tool 30 and a female tool (not shown). The hot pressing may additionally impart a 3D shape into the air-laid blank 10 and the resulting 3D shaped product 20 by any protrusion 31 extending from the male tool 30. This means that different parts of the air-laid blank 10 will generally be hot pressed differently hard depending on whether a part is aligned with the protrusion(s) 31 of the male tool 30 or not. The hot pressing of the male tool 30 into the air-laid blank 10 or the hot pressing of the air-laid blank 10 between the male tool 30 and the female tool will at least partly compact and thereby densify the material, i.e., lead to an increase in density and thereby a reduction in porosity and the open cell foam structure of the air-laid blank 10.

Hot pressing of prior art air-laid blanks 10 will not only increase the average density of the 3D shaped product 20 as compared to the average density of the air-laid blank 10 but will also lead to significantly increased density, and thereby significantly reduced porosity and reduced open cell foam structure, in those parts of the air-laid blank 10 that are engaged with the protrusion(s) 31 in the male tool 30. Hence, at least some parts of the air-laid blank 10 will be pressed comparatively hard when the male tool 30 is pressed into the air-laid blank 10 or when the air-laid blank 10 is hot pressed between the male tool 30 and the female tool. These hard pressed parts will thereby be compacted more than remaining parts of the air-laid blank 10 and these hard pressed parts will therefore be less porous and will have less open cell foam structure in the resulting 3D shaped product 20 as compared to the other parts. Accordingly, the hard pressed parts in the resulting 3D shaped product 20 will have reduced shock absorbing or damping ability and comparatively poorer thermal insulation as compared to the less pressed parts of the resulting 3D shaped product 20.

The present embodiments solve the above shortcomings by having at least a portion 11 of the air-laid blank 10 with a density that is preferably lower than the average density of the air-laid blank 10. This portion 11 of the air-laid blank 10 will, even if hot pressed harder than other parts 15 of the air-laid blank 10, still maintain at least a portion of the porosity of the air-laid blank 10 in the 3D shaped product 20. Hence, portions 11 of the air-laid blank 10 that are to be pressed harder than other parts of the air-laid blank 10 during the hot pressing, such as aligned with protrusion(s) 31 of the male tool 30, preferably have a lower density than the average density of the air-laid blank 10. This means that densities and thereby the porosities in different parts of the resulting 3D shaped product 20 will be more similar as compared to hot pressing an air-laid blank 10 with a uniform density and porosity.

FIG. 1 schematically illustrate a cross-sectional view of an air-laid blank 10 positioned on a base platen 40. In the illustrated embodiment, a single portion 11 of the air-laid blank 10 has a lower density as compared to the average density of the air-laid blank 10 and of other portions 15 of the air-laid blank 10. FIG. 8 illustrates this air-laid blank 10 in connection with hot pressing of a male tool 30 comprising a single protrusion 31 substantially aligned with the low-density portion 11 of the air-laid blank 10. The protrusion 31 preferably has a cross-sectional shape substantially corresponding to the cross-sectional shape of the low-density portion 11. FIG. 9 illustrates a resulting 3D shaped product 20 formed in the hot pressing. The 3D shaped product 20 comprises a cavity 22 formed by the protrusion 31 pressed into the low-density portion 11 of the air-laid blank 10. Even if this low-density portion 11 is hot pressed harder than other portions 15 of the air-laid blank 10 the corresponding portion 21 in the 3D shaped product 20 adjacent the cavity 22 has a density and porosity that is more similar to the density and porosity of other parts 25 of the 3D shaped product 20, which have not been engaged with the protrusion 31 of the male tool 30 and thereby have not been hot pressed equally hard.

Hence, although the low-density portion 11 of the air-laid blank 10 has been hot pressed harder than other portions 15 of the air-laid blank 10 the corresponding portion 21 in the 3D shaped product preferably has a density similar to or slightly higher than the density of other portions 25 of the 3D shaped product 20.

In the prior art air-laid blanks 10 having uniform densities, hard pressed portions in the 3D shaped products may have a density that is 10 to 50 times higher than other portions of the 3D shaped products that have not been pressed equally hard.

In an embodiment, the density of the hard pressed portion 21 in the 3D shaped product 20 is equal to or less than 5 times the average density of the 3D shaped product 20, preferably equal to or less than 4 times, such as equal to or less than three times or equal to or less than twice the average density of the 3D shaped product 20. For instance, the density of the hard pressed portion 21 in the 3D shaped product could be equal to or less than 190%, equal to or less than 180%, equal to or less than 170%, equal to or less than 160%, equal to or less than 150%, equal to or less than 140%, equal to or less than 130%, equal to or less than 120%, or even equal to or less than 110% of the average density of the 3D shaped product 20. In a particular embodiment, the 3D shaped product 20 has substantially uniform density.

Figure 10:
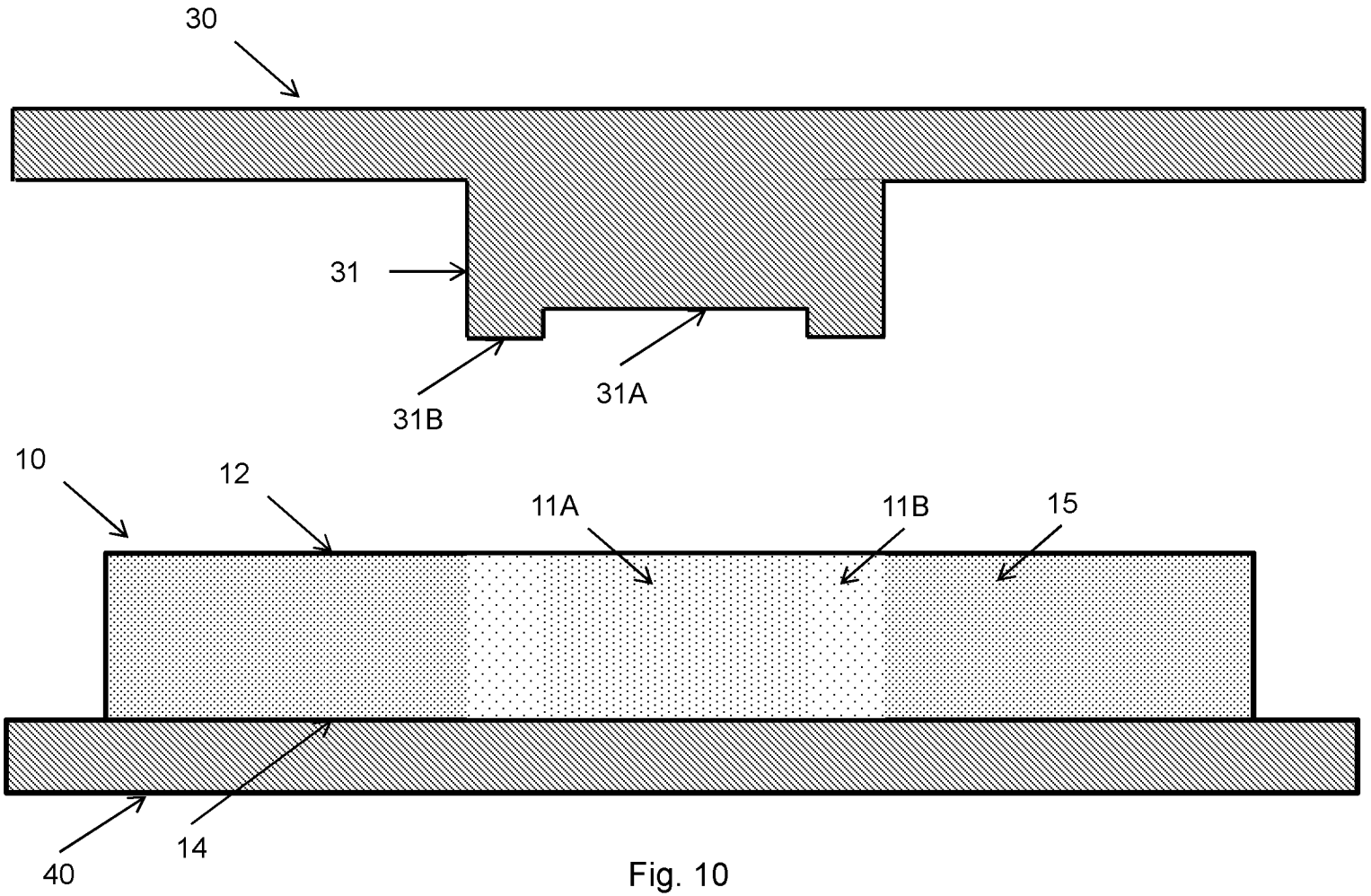
FIG. 10 schematically illustrates hot pressing of a male tool into the air-laid blank shown in FIG. 2.

In FIG. 1, a single portion 11 having a density different from, preferably lower than, the average density of the air-laid blank 10 is shown. The embodiments are, however, not limited thereto. The air-laid blank 10 may comprise multiple, i.e., at least two, portions 11 having a density different from, preferably lower than, the average density of the air-laid blank 10. In such a case, all these multiple portions 11 may have the same density or they may have different densities. FIG. 2 illustrates an example of the latter case. In this example, the air-laid blank 10 comprises a first portion 11A having a first density and a second portion 11B having a second, different density. In addition, both the first and second densities are different from, preferably less than, the average density of the air-laid blank 10, and thereby of remaining portions 15 of the air-laid blank 10. FIGS. 10 and 11 illustrate a male tool 30 and hot pressing of the air-laid blank 10 as shown in FIG. 2. In this example, the male tool 30 comprises a protrusion 31 with a main part 31A to be aligned with the first portion 11A of the air-laid blank 10 and an outer or circumferential part 31B to be aligned with the second portion 11B of the air-laid blank 10. The circumferential protrusion part 31B extends further towards the air-laid blank 10 as compared to the main protrusion part 31A. This means that during hot pressing, the second portion 11B of the air-laid blank 10 will be hot pressed harder than the first portion 11A of the air-laid blank 10, which in turn will be hot pressed harder than the remaining portion 15 of the air-laid blank 10. Hence, in a preferred embodiment of this example, the density of the second portion 11B is lower than the density of the first portion 11A, which in turn is lower than the average density of the air-laid blank 10 and also of the density of the remaining portion 15 of the air-laid blank 10.

FIG. 11 illustrates a cross-sectional view of the 3D shaped product 20 formed in the hot pressing shown in FIG. 10. The 3D shaped product 20 comprises a cavity 22 formed by the shape of the male tool 30, and in particular by the shape of the protrusion 31. Although the portions 21A, 21B of the 3D shaped product 20 aligned with the cavity 22 have been hot pressed harder than other portions 25 of the 3D shaped product 20 the densities and thereby the porosities of these portions 21A, 21B are preferably still within acceptable ranges for them to have shock absorbing or damping ability and/or good thermal insulation.

The portion 11 of the air-laid blank 10 has a density different from, such as lower than, the average density of the air-laid blank prior to exposing the air-laid blank 10 to any compression. Hence, the air-laid blank 10 comprises portions 11, 15 with different densities before compressing the air-laid blank 10 or any part thereof. Compressing the air-laid blank 10 as referred to herein encompass any cold or hot compressing, calendering or pressing operation that is traditionally used to compact air-laid blanks 10.

In an embodiment, the at least one portion 11 of the air-laid blank 10 having a density different from, preferably lower than, the average density of the air-laid blank 10 has a two-dimensional (2D) extension parallel with the two parallel planar major surfaces 12, 14 of the air-laid blank 10 and extends through the whole thickness of the air-laid blank 10 as shown in FIGS. 1 and 2.

For instance, the at least one portion 11 could have any geometrical 2D extension parallel with the major surfaces 12, 14 including, but not limited to, circle, ellipse, square, rectangle, triangle, polygon or even more irregular shapes. In an embodiment, the at least one portion 11 extends through the whole thickness of the air-laid blank 10. In such a case, the wall(s) of the at least one portion 11 extending through the thickness of the air-laid blank 10 may be straight, i.e., perpendicular to the major surfaces 12, 14. In such a case, the at least one portion 11 may, for instance, be in the form of a prism or a right cylinder depending on the cross-sectional shape of the at least one portion 11.

The embodiments are, however, not limited to having straight perpendicular walls and also comprise portions 11 having sloping, concave, convex, and/or parabola wall or walls.

In the embodiments shown in FIGS. 1 and 2, the portion 11 having a density different from, preferably lower than, the average density of the air-laid blank 10 extends through the whole thickness of the air-laid blank 10. The embodiments are, however, not limited thereto. The portion 11 may, hence, constitute merely a portion of the thickness of the air-laid blank 10. FIG. 3 illustrates a cross-sectional view of an air-laid blank 10 according to such an example. In this embodiment, the air-laid blank 10 comprises a cavity 13 extending into but not through a whole thickness of the air-laid blank 10. In such an embodiment, the portion 11 of the air-laid blank 10 having a different, preferably lower, density than the average density of the air-laid blank 10 is then aligned with the cavity 13 as shown in FIG. 3. Hence, the portion 11 is formed on top of (as in FIG. 3) or below the cavity 13.

The two major surfaces 12, 14 of the air-laid blank 10 are substantially planar surfaces as illustrated in FIGS. 1 and 2. In addition, the two major surfaces 12, 14 are parallel. As a consequence, the air-laid blank 10 preferably has a uniform thickness.

In an embodiment, the air-laid blank 10 has a thickness of at least 20 mm, preferably at least 30 mm and more preferably at least 40 mm, or even thicker, such as at least 50 mm, at least 60 mm, at least 70 mm, at least 80 mm or at least 90 mm. In a particular embodiment, the air-laid blank 10 has a thickness of at least 100 mm, such as at least 150 mm, at least 200 mm, or at least 250 mm. It is also possible to have very thick air-laid blanks 10 having a thickness of at least 300 mm.

In an embodiment, the natural fibers are wood fibers. In a particular embodiment, the natural fibers are cellulose and/or lignocellulose fibers. Hence, in an embodiment, the natural fibers contain cellulose, such as in the form of cellulose and/or lignocellulose, i.e., a mixture of cellulose and lignin. The natural fibers may also contain lignin, such as in the form of lignocellulose. The natural fibers may additionally contain hemicellulose. In a particular embodiment, the natural fibers are cellulose and/or lignocellulose pulp fibers produced by chemical, mechanical and/or chemi-mechanical pulping of softwood and/or hardwood. For instance, the cellulose and/or lignocellulose pulp fibers are in a form selected from the group consisting of sulfate pulp, sulfite pulp, thermomechanical pulp (TMP), high temperature thermomechanical pulp (HTMP), mechanical fiber intended for medium density fiberboard (MDF-fiber), chemi-thermomechanical pulp (CTMP), high temperature chemi-thermomechanical pulp (HTCTMP), and a combination thereof.

The natural fibers can also be produced by other pulping methods and/or from other cellulosic or lignocellulosic raw materials, such as flax, jute, hemp, kenaf, bagasse, cotton, bamboo, straw or rice husk.

The air-laid blank 10 comprises the natural fibers in a concentration of at least 70% by weight of the air-laid blank 10. In a preferred embodiment, the air-laid blank 10 comprises the natural fibers in a concentration of at least 72.5%, more preferably at least 75%, such as at least 77.5%, at least 80%, at least 82.5%, at least 85% by weight of the air-laid blank 10. In some applications, even higher concentrations of the natural fibers may be used, such as at least 87.5%, or at least 90%, at least 92.5%, at least 95% or at least 97.5% by weight of the air-laid blank 10.

The thermoplastic polymer binder is included in the air-laid blank 10 as binder to bind the air-laid blank 10 together and preserve its form and structure during use, handling and storage. The thermoplastic polymer binder may also assist in building up the foam-like structure of the air-laid blank 10. The thermoplastic polymer binder is intermingled with the natural fibers during the air-lying process forming a fiber mixture. The thermoplastic polymer binder may be added in the form of a powder, but is more often added in the form of fibers that are intermingled with the natural fibers in the air-laying process. Alternatively, or in addition, the thermoplastic polymer binder may be added as solution, emulsion or dispersion into and onto the air-laid blank 10 during the air-laying process.

In a particular embodiment, the thermoplastic polymer binder is selected from the group consisting of a thermoplastic polymer powder, thermoplastic polymer fibers and a combination thereof.

In an embodiment, the thermoplastic polymer binder, or at least a portion thereof, has a softening point not exceeding a degradation temperature of the natural fibers. Hence, the thermoplastic polymer binder thereby becomes softened at a process temperature during heating and hot pressing that does not exceed the degradation temperature of the natural fibers. This means that the thermoplastic polymer binder becomes malleable and maintains the at least partly porous structure of the 3D shaped product 20 at a temperature that does not degrade the natural fibers in the air-laid blank 10.

In an embodiment, the thermoplastic polymer binder is made from i) a material selected from the group consisting of polyethylene (PE), ethylene acrylic acid copolymer (EAA), ethylene-vinyl acetate (EVA), polypropylene (PP), polystyrene (PS), polybutylene adipate terephthalate (PBAT), polybutylene succinate (PBS), polylactic acid (PLA), polyethylene terephthalate (PET), polycaprolactone (PCL), copolymers thereof and mixtures thereof, and ii) optionally one or more additives.

Hence, in an embodiment, the thermoplastic polymer binder is made of a material selected from the above mentioned group. In another embodiment, the thermoplastic polymer binder is made of a material selected from the above mentioned group and one or more additives.

In an embodiment, the thermoplastic polymer binder is or comprises thermoplastic polymer fibers cut at a fixed length, which are typically referred to as staple fibers. It is generally preferred for the mixing in the air-laying process and, thereby, for the properties of the formed air-laid blank 10 if the length of the thermoplastic polymer fibers is of the same order of magnitude as the length of the natural fibers or longer. Length of the thermoplastic polymer fibers and the natural fibers as referred to herein is length weighted average fiber length. Length weighted average fiber length is calculated as the sum of individual fiber lengths squared divided by the sum of the individual fiber lengths.

In an embodiment, the thermoplastic polymer binder is or comprises thermoplastic polymer fibers having a length weighted average fiber length that is selected within an interval of from 100 up to 600%, preferably from 125 up to 500%, and more preferably from 150 up to 450% of a length weighted average fiber length of the natural fibers. In a particular embodiment, the thermoplastic polymer binder is or comprises thermoplastic polymer fibers having a length weighted average fiber length that is selected within an interval of from 200 up to 400%, preferably within an interval of from 250 up to 350% of a length weighted average fiber length of the natural fibers. In a particular embodiment, the thermoplastic polymer fibers have a length weighted average fiber length within an interval of from 1 up to 10 mm, preferably within an interval of from 2 up to 8 mm and more preferably within an interval of from 2 up to 6 mm.

The length weighted average fiber length of the natural fibers is dependent on the source of the natural fibers, such as tree species they are derived from, and the pulping process. A typical interval of length weighted average fiber length of wood pulp fibers is from about 0.8 mm up to about 5 mm.

In an embodiment, the thermoplastic polymer binder is or comprises, such as consists of, mono-component and/or bi-component thermoplastic polymer fibers. Bi-component thermoplastic polymer fibers, also known as bico fibers, comprise a core and sheath structure, where the core is made from a first polymer, copolymer and/or polymer mixture and the sheath is made from a second, different polymer, copolymer and/or polymer mixture.

In a particular embodiment, the thermoplastic polymer binder is or comprises, such as consists of, mono-component thermoplastic polymer fibers made of i) a material selected from the group consisting of PE, EAA, EVA, PP, PS, PBAT, PBS, PLA, PET, PCL, copolymers thereof and mixtures thereof, and ii) optionally one or more additives. In another particular embodiment, the thermoplastic polymer binder is or comprises, such as consists of, bi-component thermoplastic polymer fibers having a core and/or sheath made of i) a material or materials selected from the group consisting of PE, EAA, EVA, PP, PS, PBAT, PBS, PLA, PET, PCL, copolymers thereof and mixtures thereof, and ii) optionally one or more additives. In a further embodiment, the thermoplastic polymer binder is or comprises, such as consists of, a combination or mixture of mono-component thermoplastic polymer fibers made of i) a material selected from the group consisting of PE, EAA, EVA, PP, PS, PBAT, PBS, PLA, PET, PCL, copolymers thereof and mixtures thereof, and ii) optionally one or more additives, and bi-component thermoplastic polymer fibers having a core and/or sheath made of i) a material or materials selected from the group consisting of PE, EM, EVA, PP, PS, PBAT, PBS, PLA, PET, PCL, copolymers thereof and mixtures thereof, and ii) optionally one or more additives.

The thermoplastic polymer binder could be made of a single type of thermoplastic polymer fibers, i.e., made of a same material in the case of mono-component thermoplastic polymer fibers or made of the same material or materials in the case of bi-component thermoplastic polymer fibers. However, it is also possible to use a thermoplastic polymer binder made of one or multiple, i.e., two or more, different mono-component thermoplastic polymer fibers made of different materials and/or one or multiple different bi-component thermoplastic polymer fibers made of different materials.

In an embodiment, the thermoplastic polymer binder is a thermoplastic polymer powder made of i) a material selected from the group consisting of PE, EM, EVA, PP, PS, PBAT, PBS, PLA, PET, PCL, copolymers thereof and mixtures thereof, and ii) optionally one or more additives.

It is also possible to use a thermoplastic polymer binder that is a combination of thermoplastic polymer fibers and thermoplastic polymer powder.

In an embodiment, the air-laid blank 10 comprises the thermoplastic polymer binder at a concentration selected within an interval of from 10 up to 30%, such as from 12.5 up to 30% or from 15 up to 30% by weight of the air-laid blank 10. In a particular embodiment, the air-laid blank 10 comprises more than 15% but no more than 30% by weight of the thermoplastic polymer binder. For instance, the air-laid blank 10 comprises the thermoplastic polymer binder at a concentration selected within an interval of from 15 or 17.5 up to 30% by weight of the air-laid blank 10. In a particular embodiment, the air-laid blank 10 comprises the thermoplastic polymer binder at a concentration selected within an interval of from 15 or 17.5 up to 25%, such as from 20 up to 25% by weight of the air-laid blank 10.

In some applications, it may be advantageous to have a comparatively higher concentration of the thermoplastic polymer binder, such as more than 15% by weight of the air-laid blank 10, in order to preserve the integrity and foam-like structure of the air-laid blank 10 even when pressing the air-laid blank 10 at a lower pressure to obtain the porous 3D shaped product 20. Thus, if too low concentration of the thermoplastic polymer binder is included, i.e., below 2.5% by weight of the air-laid blank 10, the formed 3D shaped product 20 may unintentionally disintegrate or fall apart since the combination of too low concentration of the thermoplastic polymer binder and a "soft" hot pressing of the air-laid blank 10 is not sufficient to keep the structure of the 3D shaped product 20.

In some embodiments, the air-laid blank 10 comprises the thermoplastic polymer binder at a concentration selected within an interval of from 2.5 up to 15% by weight of the air-laid blank 10, preferably within an interval of from 4 up to 15%, such as from 5 up to 15% by weight or the air-laid blank 10, or within an interval of from 7.5 up to 15% by weight of the air-laid blank 10, and more preferably within an interval of from 10 up to 15% by weight of the air-laid blank 10.

In an embodiment, the 3D shaped product 20 is configured to protect the packaged goods from electrostatic discharge (ESD). In such an embodiment, the air-laid blank 10 is electrically conducting or semiconducting. For instance, the air-laid blank 10 could comprise an electrically conducting polymer or electrically conducting fibers to make the air-laid blank 10 and, thereby, the 3D shaped product 20 formed by hot pressing the air-laid blank 10, electrically conducting or semiconducting. In such a case, the air laid blank 10 preferably comprises the electrically conducting polymer or fibers at a concentration of no more than 10% by weight of the air-laid blank 10, and more preferably of no more than 5% by weight of the air-laid blank 10. In an embodiment, a portion of the natural fibers may be replaced with electrically conducting polymer or fibers. In another embodiment, the thermoplastic polymer binder is made of, or comprises, an electrically conducting polymer. In a further embodiment, these two embodiments are combined. In a particular embodiment, the electrically conducting polymer or fibers are carbon fibers. Instead of, or as a complement to, having electrically conducting polymer or fibers, the air-laid blank 10 could comprise an electrically conducting or semiconducting fillers, such as carbon black, which, for instance, could be in the form of an additive to the binder.

The air-laid blank 10 may, thus, comprise one or more additives in addition to the natural fibers and the thermoplastic polymer binder. One or more additives could be added to the thermoplastic polymer binder and/or added when producing the thermoplastic polymer binder. Alternatively, or in addition, one or more additives could be added to the natural fibers. Alternatively, or in addition, one or more additives could be added to the natural fibers and the thermoplastic polymer binder, such as during the air-laying process.

Illustrative, but non-limiting, examples of such additives include electrically conducting or semiconducting fillers, coupling agents, flame retardants, dyes, impact modifiers, etc.

In some applications, it may be desirable to seal some or all of the surfaces of the 3D shaped product 20, such as by heat, to prevent linting from the surface(s) onto the packaged goods. Surfaces that are processed with heat in the hot pressing will be sealed and do not need any additional (heat) sealing. The at least one surface to be sealed can be sealed, such as by heat, before or after the hot pressing operation. Hence, in an embodiment, the 3D shaped product 20 comprises at least one surface that is heat sealed to inhibit linting from the at least one surface. For instance, end surfaces of the 3D shaped product 20 may be unprocessed from the air-laid blank 10 or may have been produced by sawing, cutting or stamping the air-laid blank 10 to produce these end surfaces. In such a case, it may be preferred to heat seal these surfaces to prevent or at least suppress or inhibit linting. Any surfaces that have been exposed to heat during the hot pressing generally do not need any heat sealing.

In some applications, the 3D shaped product 20, or at least a portion thereof, can be laminated with a surface layer, such as a thermoplastic polymer film or non-woven textile. This can both prevent linting and add additional functions to the surface, such as moisture barriers, haptic properties, color and designs. The film or non-woven could be made from any common thermoplastic polymer. Examples include the previously mentioned thermoplastic polymer materials for usage as binders. This layer could be heat laminated or extruded to the air-laid blank 10 and/or laminated directly onto the 3D shaped product 20. In an embodiment, the film laminated to at least one surface, or a portion thereof, of the 3D shaped product 20 is electrically conducting or semi-conducting to provide ESD protection of the packaged goods.

Hence, in an embodiment, the 3D shaped product 20 comprises at least one surface coated with a surface layer selected from the groups consisting of a linting inhibiting layer, a moisture barrier layer, a haptic layer and a colored layer.

The film, textile or surface layer may be attached to the air-laid blank 10 or the 3D shaped product 20 by help of a thin layer of a hotmelt glue, by an additional adhesive film or by its own having become semi-melted and tacky during the heat lamination process. This operation can be performed before, after or simultaneously with the hot pressing operation. If the lamination is performed on at least one surface of the air-laid blank 10, which is later to be processed by hot pressing, the softening point of the surface laminate should not exceed the degradation temperature of the natural fibers of the air-laid blank 10.

In further embodiments, it is possible to apply the surface layer by spraying it onto surface (s) of the 3D shaped product 20 or the air-laid blank 10. The layer may then contain any substance(s) that can be prepared as solutions, emulsions or dispersions, such as thermoplastic polymers; natural polymers, such as starch, agar, guar gum or locust bean gum, microfibrillar or nanofibrillar cellulose or lignocellulose or mixtures thereof. The surface layer may in addition comprise other substances, such as emulsifying agents, stabilizing agents, electrically conductive agents, etc. that provide additional functionalities to the surface layer and the 3D shaped product 20.

Figure 4:
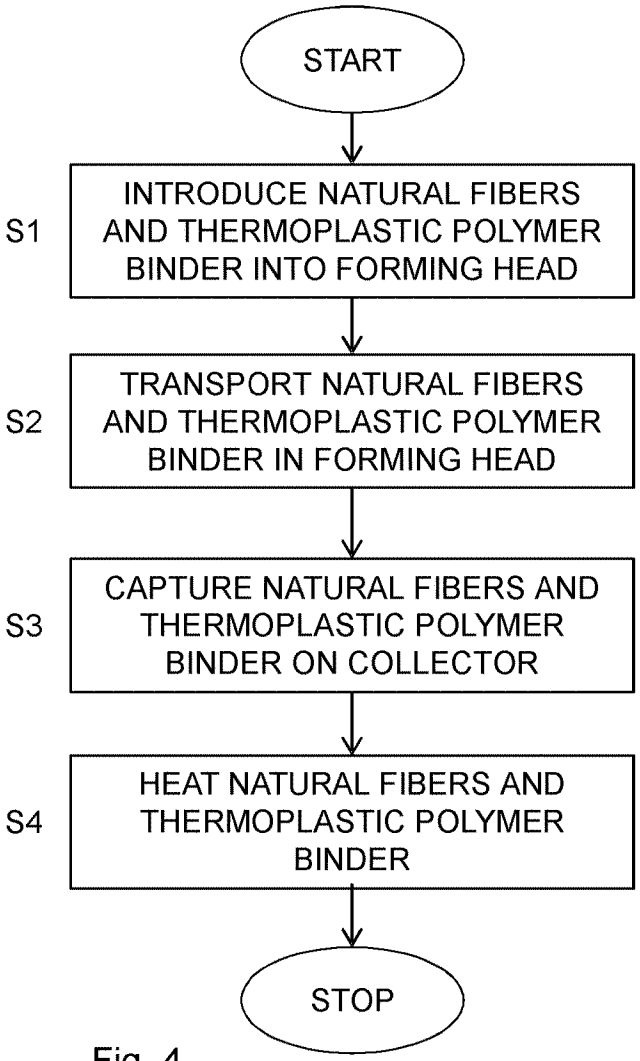
FIG. 4 is a flow chart illustrating a method of producing an air-laid blank according to an embodiment.
Figure 7:
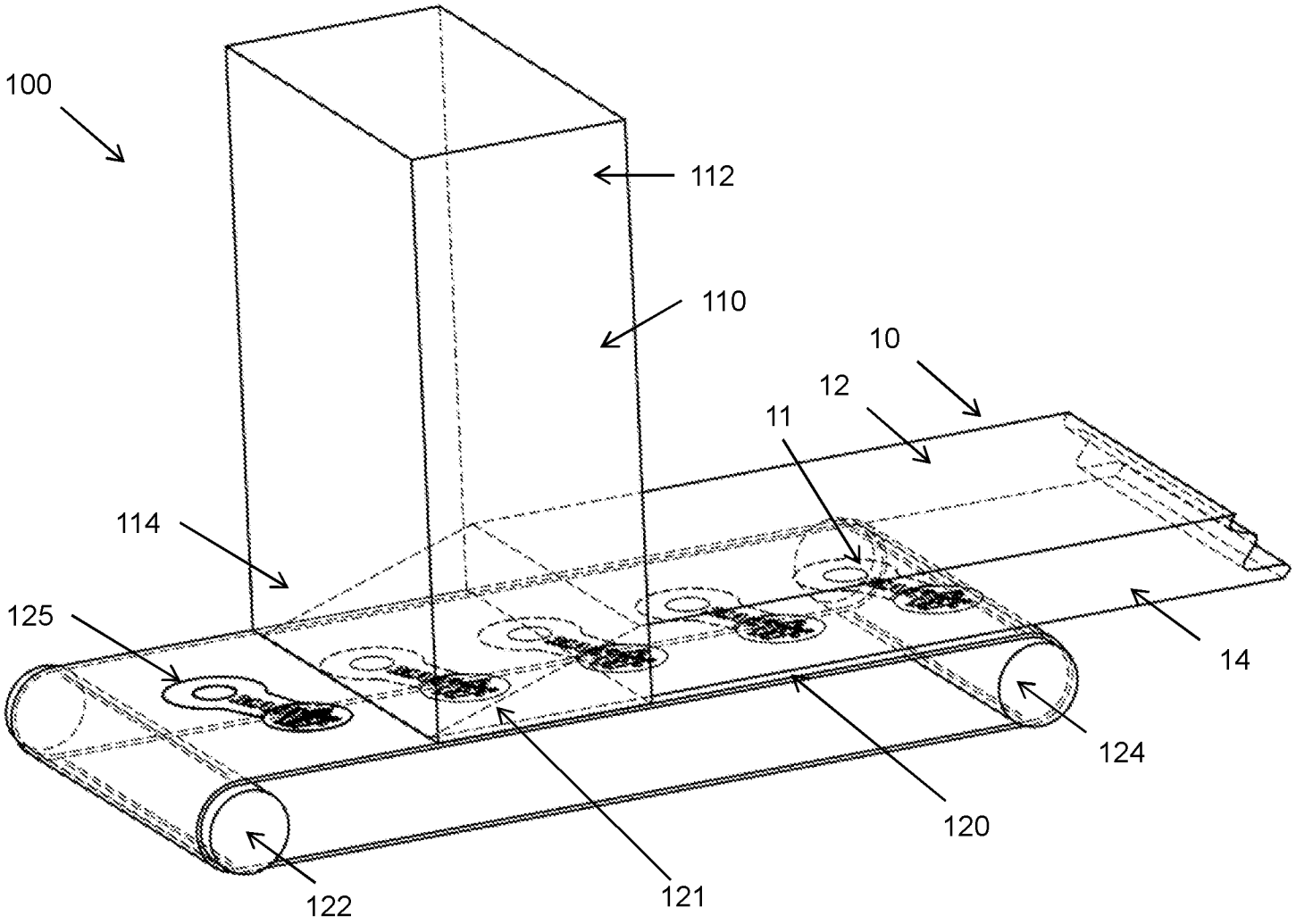
FIG. 7 is a schematic illustration of an apparatus for producing an air-laid blank according to an embodiment.

Another aspect of the invention relates to a method of producing an air-laid blank 10, see FIG. 4 and FIG. 7 showing an embodiment of an apparatus 100 for producing an air-laid blank 10. The method comprises introducing, in step S1, natural fibers and a thermoplastic polymer binder and/or a mixture of the natural fibers and the thermoplastic polymer binder into an upper end 112 of a forming head 110. The method also comprises, transporting, in step S2, the natural fibers and the thermoplastic polymer binder and/or the mixture to a lower end 114 of the forming head 110 by vacuum applied over an air-permeable collector 120 arranged in connection with the lower end 114 of the forming head 110. The method further comprises capturing, in step S3, the natural fibers and the thermoplastic polymer binder and/or the mixture on the air-permeable collector 120. The method additionally comprises heating, in step S4, the natural fibers and the thermoplastic polymer binder and/or the mixture to form an air-laid blank 10.

According to this aspect, the air-laid blank 10 comprises the natural fibers at a concentration of at least 70% by weight of the air-laid blank 10 and the thermoplastic polymer binder at a concentration selected within an interval of from 2.5 up to 30% by weight of the air-laid blank 10.

The air-permeable collector 120 has an average air-permeability. In an embodiment, a portion 121 of the air-permeable collector 120 has an air-permeability different from the average air-permeability. Alternatively, or in addition, an object 125 is positioned on a portion 121 of the air-permeable collector 120. In such a case, the portion 121 of the air-permeable collector 120 with the object 125 positioned thereon has an air-permeability different from the average air-permeability. According to the invention, the air-laid blank 10 has an average density and a portion 11 of the air-laid blank 10 aligned with the portion 121 of the air-permeable collector 120 has a density different from the average density. The air-laid blank 10 has two parallel planar major surfaces 12, 14.

The apparatus 100 used for producing an air-laid blank 10 comprises a forming head 110, also referred to as forming chamber in the art. The natural fibers and the thermoplastic polymer binder are input into the forming head 110 as one or more discrete input streams and/or as one or more mixed input streams. For instance, the forming head 110 may, in its upper end 112, comprise one stream input for the natural fibers and one stream input for the thermoplastic polymer binder. In another embodiment, the forming head 110 comprises multiple stream inputs for the natural fibers and one stream input for the thermoplastic polymer binder, one stream input for the natural fibers and multiple stream inputs for the thermoplastic polymer binder or multiple stream inputs for the natural fibers and multiple stream inputs for the thermoplastic polymer binder. In these illustrative examples, the natural fibers and the thermoplastic polymer binder are mixed and blended during the transport through the forming head 110 ultimately depositing the mixture of natural fibers and the thermoplastic polymer binder on the air-permeable collector 120.

Instead of, or as a complement to, having one or more input streams for the natural fibers and/or one or more input streams for the thermoplastic polymer binder, a pre-formed mixture between the natural fibers and the thermoplastic polymer binder may be introduced into the forming head 110 at one or multiple stream inputs.

The natural fibers and the thermoplastic polymer binder and/or the mixture thereof is transported in step S2 through the forming head 110 from the upper end 112 to the lower end 114 by a vacuum, i.e., an air suction or under pressure, applied over the air-permeable collector 120 that is disposed in connection with the lower end 114 of the forming head 110.

The vacuum applied over the air-permeable collector 120, thus, draws the natural fibers and the thermoplastic polymer binder and/or the mixture thereof towards the lower end 114 of the forming head 110 and down onto the air-permeable collector 120. The vacuum may also contribute to the mixing of natural fibers and the thermoplastic polymer binder during the transport through the forming head 110 and compact the fibrous mixture on the air-permeable collector 120.

The collector 120 is air-permeable to allow application of the vacuum thereover and draw the natural fibers and the thermoplastic polymer binder onto the collector 120. For instance, the air-permeable collector 120 could comprise a plurality of openings, through holes or channels for allowing air to be sucked or drawn through the air-permeable collector 120. However, any such openings are preferably small enough to prevent the natural fibers and the thermoplastic polymer binder from passing through the air-permeable collector 120. Hence, the natural fibers and the thermoplastic polymer binder are instead deposited as a fibrous mixture onto the air-permeable collector 120.

The applied vacuum causes a compaction of the natural fibers and the thermoplastic polymer binder on the air-permeable collector 120. The density and thereby the porosity of at least a portion 11 of the resulting air-laid blank 10 is controlled or modified by having a portion 121 of the air-permeable collector 120 with an air-permeability that is different from the average air-permeability of the collector 120 and/or by positioning an object 125 onto a portion 121 of the air-permeable collector 120 where this object 125 causes the air-permeability of the portion 121 with the object 125 positioned thereon to be different from the average air-permeability of the air-permeable collector 120.

The portion 121 of the air-permeable collector 120 and/or the object 125 positioned on the portion 121 of the air-permeable collector 120 thereby locally affects the vacuum and air suction through the air-permeable collector 120 so that the vacuum and air suction at this portion 121 of the air-permeable collector 120 will be different as compared to the vacuum and air suction at other portions of the air-permeable collector 120. This local modification in vacuum and air suction is possible since the portion 121 of the air-permeable collector 120 and/or the portion 121 with the object 125 has an air-permeability different from the average air-permeability of the air-permeable collector 120.

In a particular embodiment, the portion 121 of the air-permeable collector 120 and/or the portion 121 with the object 125 has an air-permeability that is lower than the average air-permeability of the air-permeable collector 120. As a result, a lower vacuum and air suction will be applied to the natural fibers and thermoplastic polymer binder and thereby to the portion 11 of the air-laid blank 10 aligned with the portion 121 of the air-permeable collector 120 and/or the object 125. The lower vacuum and air suction will in turn lead to a less compaction of the natural fibers and thermoplastic polymer binder in this portion 11 of the air-laid blank 10. Accordingly, this portion 11 of the air-laid blank 10 will have a density that is different from, preferably lower, than the average density of the air-laid blank 10.

Figure 5:
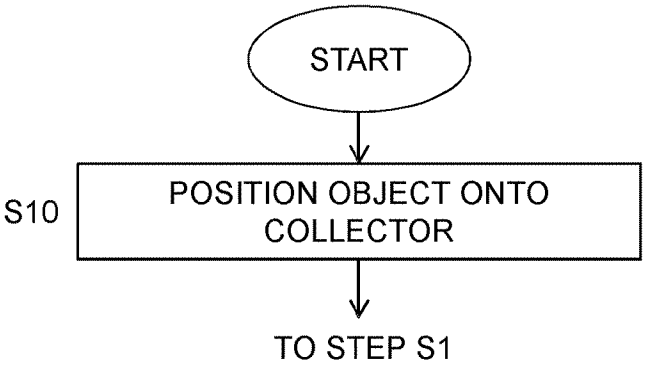
FIG. 5 is a flow chart illustrating an additional, optional step of the method shown in FIG. 4.

The air-permeable collector 120 could comprise one or more portions 121 with different air-permeability as compared to other portions of the air-permeable collector 120. In another embodiment, at least one object 125 is positioned onto the air-permeable collector 120 as schematically shown in FIG. 7. In such an embodiment, the method comprises an additional step S10 as shown in FIG. 5. This step S10, thus, comprises positioning the object 125 onto the air-permeable collector 120.

The object 125 could be any object that adjusts or modifies the air-permeability in a portion 121 of the air-permeable collector 120 when positioned on this portion 121 of the air-permeable collector 120. A typical example of object 125 that could be used according to the embodiments is a porous object 125 having a number of channels or passages passing through the thickness of the object 125 and allowing air to pass through these channels or passages. The object 125 could have a uniform air-permeability or different parts of the object 125 could have different air-permeability. For instance, the porosity of the object 125 could be different in different parts of the object 125. In a particular embodiment, the object 125 has an air-permeability different from the average air-permeability of the air-permeable collector 120.

Another example of object 125 that could be used according to the embodiments is a non-porous object 125 that is substantially non-permeable. Such non-permeable objects 125 are in particular suitable for producing air-laid blanks 10 with portions 11 having a low density. It is also possible to have an object 125 that comprises at least one part that is permeable and at least one part that is non-permeable.

The object 125 could be made of various materials including, but not limited to, plastics, polymers, metals, including metal alloys, etc.

The shape or form of the object 125 in a plane parallel with the air-permeable collector 120 when positioned thereon defines the shape or form of the portion 11 of the air-laid blank 10 having a density that is different from the average density of the air-laid blank 10.

The air-permeable collector 120 could be a plate, disc or similar planar collector 120 that is arranged in connection with the lower end 114 of the forming head 110. Once the air-laid blank 10 has been formed on the air-permeable collector 120, the collector 120 may be removed from the forming head 110 with the air-blank 10 positioned thereon.

In another embodiment, which enables a continuous manufacture of air-laid blanks 10, the air-permeable collector 120 could be in the form an air-permeable belt collector 120 running between drive rollers 122, 124 as shown in FIG. 7. In such a case, the object 125, if used, may be positioned in step S10 of FIG. 5, onto the air-permeable belt collector 120 at a position upstream of the forming head 110.

Upstream relates to the movement direction of the air-permeable belt collector 120 from the drive roller 122 towards the drive roller 124. Hence, at this upstream position the at least one object 125 can be placed on the air-permeable belt collector 120 and thereby be transported by the action of the drive rollers 122, 124 into the forming head 110 and thereby allowing the mixture of natural fibers and thermoplastic polymer binder to be deposited onto the air-permeable belt collector 120 and the object 125, while vacuum is applied over the air-permeable belt collector 120. The air-permeable belt collector 120 is moved with the object 125 and the mixture of natural fibers and thermoplastic polymer binder thereon to output them from the forming head 110.

The natural fibers and thermoplastic polymer binder and/or the mixture thereof are heated to form an air-laid blank 10. This heating step may be performed in an oven (not illustrated in FIG. 7) that either constitutes a part of the forming head 110 or is, typically, arranged downstream of the forming head 110. The natural fibers and the thermoplastic polymer binder are preferably heated to a temperature where the thermoplastic polymer binder is in a malleable state or in a melted state, preferably in a malleable but not melted state. For most thermoplastic polymer binders this temperature is within an interval of from 80° C. up to 180° C., such as from 100° C. up to 180° C. or from 120° C. up to 160° C. Hence, in an embodiment, the heating as applied in step S4 of FIG. 4 is preferably to a temperature within the interval of from 80° C. up to 180° C.

A further aspect of the embodiments relates to a method of producing a 3D shaped product 20, see FIGS. 8 to 12. The method comprises hot pressing, in step S20 of FIG. 12, of a male tool 30 into an air-laid blank 10 to form a 3D shaped product 20 having a 3D shape at least partly defined by the male tool 30. The air-laid blank 10 comprises natural fibers at a concentration of at least 70% by weight of the air-laid blank 10 and a thermoplastic polymer binder at a concentration selected within an interval of from 2.5 up to 30% by weight of the air-laid blank 10. The air-laid blank 10 has an average density and a portion 11 of the air-laid blank 10 has a density different from the average density. The male tool 30 employed in the hot pressing in step S20 comprises a protrusion 31 configured to be pressed into the air-laid blank 10 as shown in FIGS. 8 and 10. The protrusion 31 is then configured to be aligned with the portion 11; 11A, 11B of the air-laid blank 10 having a density different from the average density of the air-laid blank 10 during the hot pressing.

Hot pressing as used herein indicates that the air-laid blank 10 is exposed to pressure exerted by pressing a male tool 30 or a male tool 30 and a female tool (not shown) into the air-laid blank 10 while the air-laid blank 10 is heated or exposed to heat. Hence, hot pressing implies that the pressing is done at a temperature above room temperature, preferably at a temperature at which the thermoplastic polymer binder is malleable.

Figure 12:
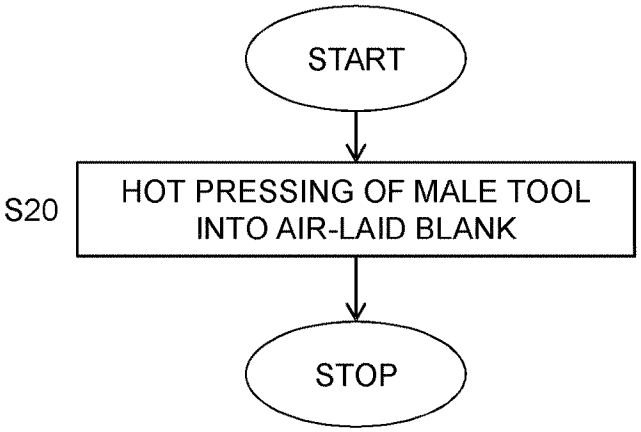
FIG. 12 is a flow chart illustrating a method of producing a 3D shaped product according to an embodiment.

In an embodiment, step S20 in FIG. 12 comprises hot pressing of a heated male tool 30 into the air-laid blank 10. In this embodiment, the heated male tool 30 is preferably heated to a temperature selected within an interval of from 120° C. up to 210° C., preferably within an interval of from 120° C. up to 190° C. The male tool 30 may then comprise heating elements that are preferably controllable heating elements to heat the male tool 30 to a desired temperature for hot pressing. The temperature of the male tool 30 typically depends on the type of natural fibers and the thermoplastic polymer binder in the air-laid blank 10 and the cycle time of the hot pressing in step S20. However, the above presented interval is suitable for most combinations of natural fibers, thermoplastic polymer binders and cycle times.

In an embodiment, the air-laid blank 10 is positioned on a base platen 40 as shown in FIGS. 8 to 11. In an embodiment, step S20 in FIG. 12 comprises hot pressing of the heated male tool 30 into the air-laid blank 10 positioned on a base platen 40 having a temperature equal to or below ambient temperature.

In these embodiments, the heating of the air-laid blank 10 is achieved by the male tool 30, whereas the base platen 40 is at ambient temperature, typically room temperature, or may even be cooled. Having a base platen 40 at ambient temperature or even cooled may reduce the risk of heating the air-laid blank 10 too much during the hot pressing in step S20, which otherwise may have negative consequences of degrading the natural fibers, melting the thermoplastic polymer binder and destroying the porous structure of the air-laid blank 10 and the formed 3D shaped product 20.

It is, though, possible to have the air-laid blank 10 positioned on a heated base platen 40 during the hot pressing in step S20 even in combination with a heated male tool 30. In such a case, also the underside of the air-laid blank 10 facing the heated base platen 40 will be heat sealed during the hot pressing.

In another embodiment, step S20 in FIG. 12, comprises hot pressing of a male tool 30 and a female tool into the air-laid blank 10 positioned in between the male tool 30 and the female tool to form the 3D shaped product 20 having the 3D shape at least partly defined by the male tool 30 and the female tool. In this embodiment, the male tool 30 forms a 3D shaped cavity 22 in the formed 3D shaped product 20, whereas the female tool comprises a 3D shaped cavity that defines the outer geometry and 3D shape of the 3D shaped product 20.

In an embodiment, both the male tool 30 and the female tool are heated, preferably to a temperature selected within an interval of from 120° C. up to 210° C., preferably within an interval of from 120° C. up to 190° C. The male tool 30 and the female tool may be heated to the same temperature or to different temperatures. In another embodiment, one of the male tool 30 and the female tool is heated, while the other is at ambient temperature.

In the above presented embodiments, at least one of the tools used in the hot pressing in step S20 is heated. In another embodiment, at least a portion of the air-laid blank 10 is heated prior to hot pressing, in step S20 in FIG. 12, of the male tool 30 into the air-laid blank 10.

Hence, rather than heating the male tool 30 and/or any female tool, the air-laid blank 10 is heated, preferably prior to the hot pressing operation. The air-laid blank 10 is then preferably heated to a temperature where the thermoplastic polymer binder is in a malleable but not melted state. For most thermoplastic polymer binders this temperature is within an interval of from 80° C. up to 180° C., such as from 100° C. up to 180° C. or from 120° C. up to 160° C. Hence, in an embodiment, the air-laid blank 10 is preferably heated to a temperature within the interval of from 80° C. up to 180° C.

In this embodiment, the male tool 30 and the base platen 40 or female tool may independently be at ambient temperature, such as room temperature, or cooled.

Alternatively, heating of the air-laid blank 10, could be combined with usage of a heated male tool 30 or a heated male tool 30 and/or a heated female tool.

In an embodiment, step S20 in FIG. 12 comprises hot pressing of the male tool 30 into the air-laid blank 10 by hot pressing the portion 11 of the air-laid blank 10 harder than other portions 15 of the air-laid blank 10 that the male tool 30 engages.

Thus, the portion 11 of the air-laid blank 10 having a density and thereby porosity different from, preferably lower than, the average density and porosity of the air-laid blank 10 is pressed correspondingly harder by the male tool 30 by being aligned with the protrusion 31 during the hot pressing. However, although the portion 11 is hot pressed harder than other portions 15, this portion 21; 21A, 21B in the resulting 3D shaped product 20 still has sufficient porosity to be suitable for shock absorption and damping and/or thermal insulation.

In an embodiment, the air-laid blank 10 hot pressed in step S20 in FIG. 12 has two parallel planar major surfaces 12, 14.

Figure 13:
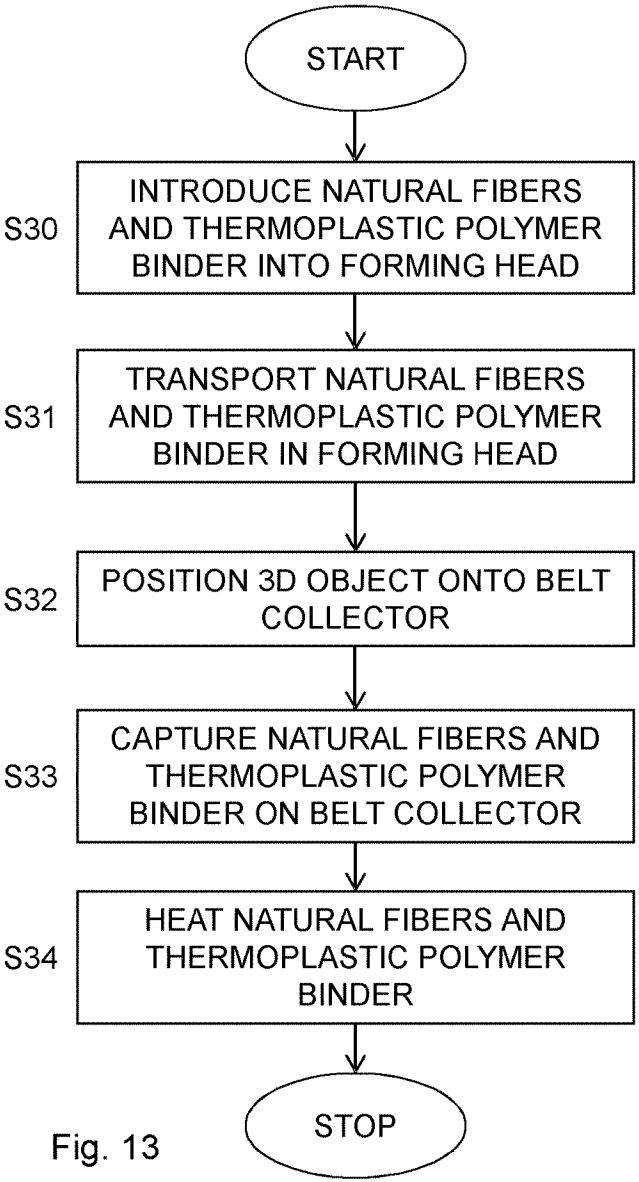
FIG. 13 is a flow chart illustrating a method of producing an air-laid blank according to another embodiment.
Figure 16:
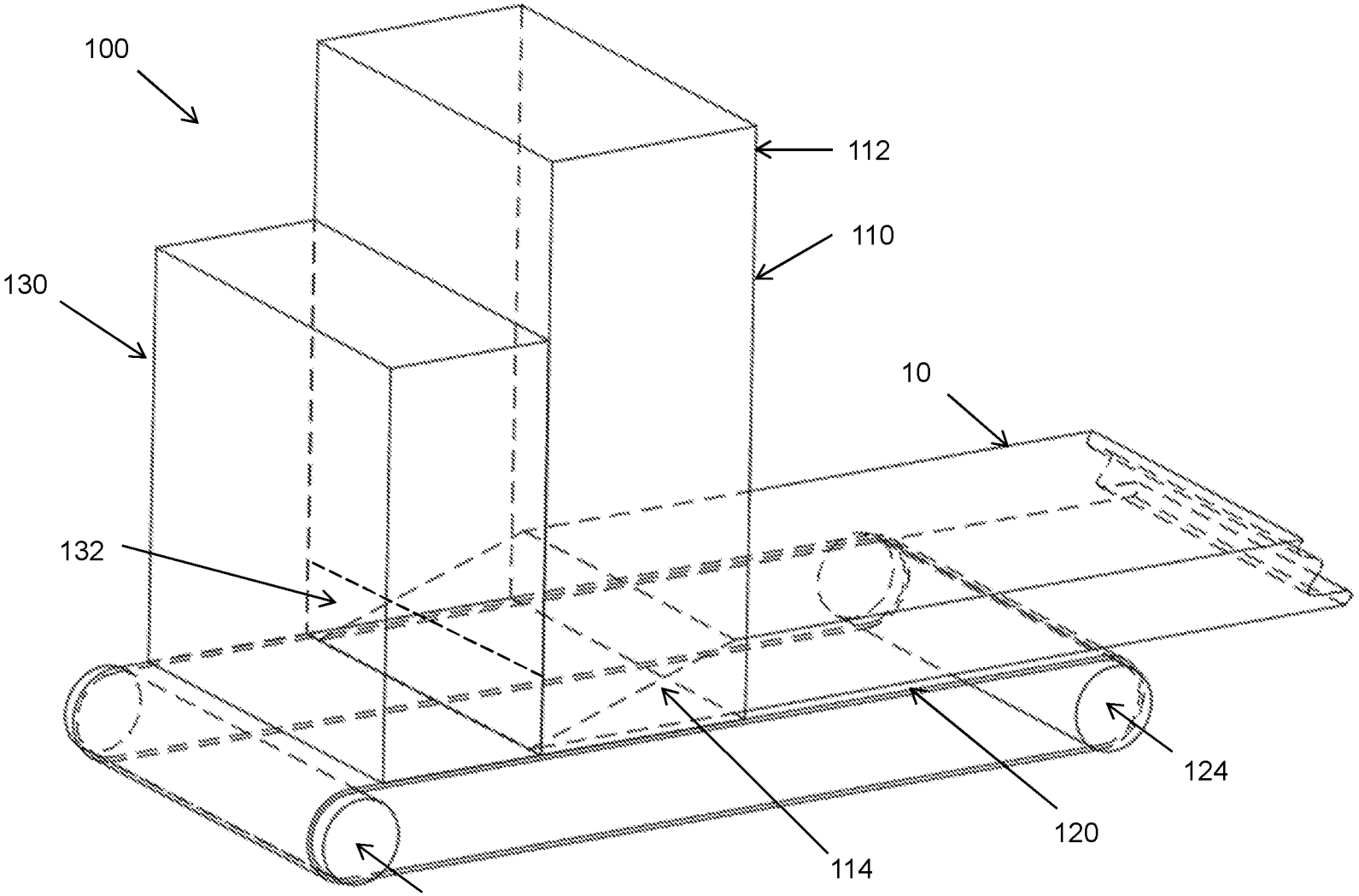
FIG. 16 is a schematic illustration of an apparatus for producing an air-laid blank according to another embodiment.
Figure 17:
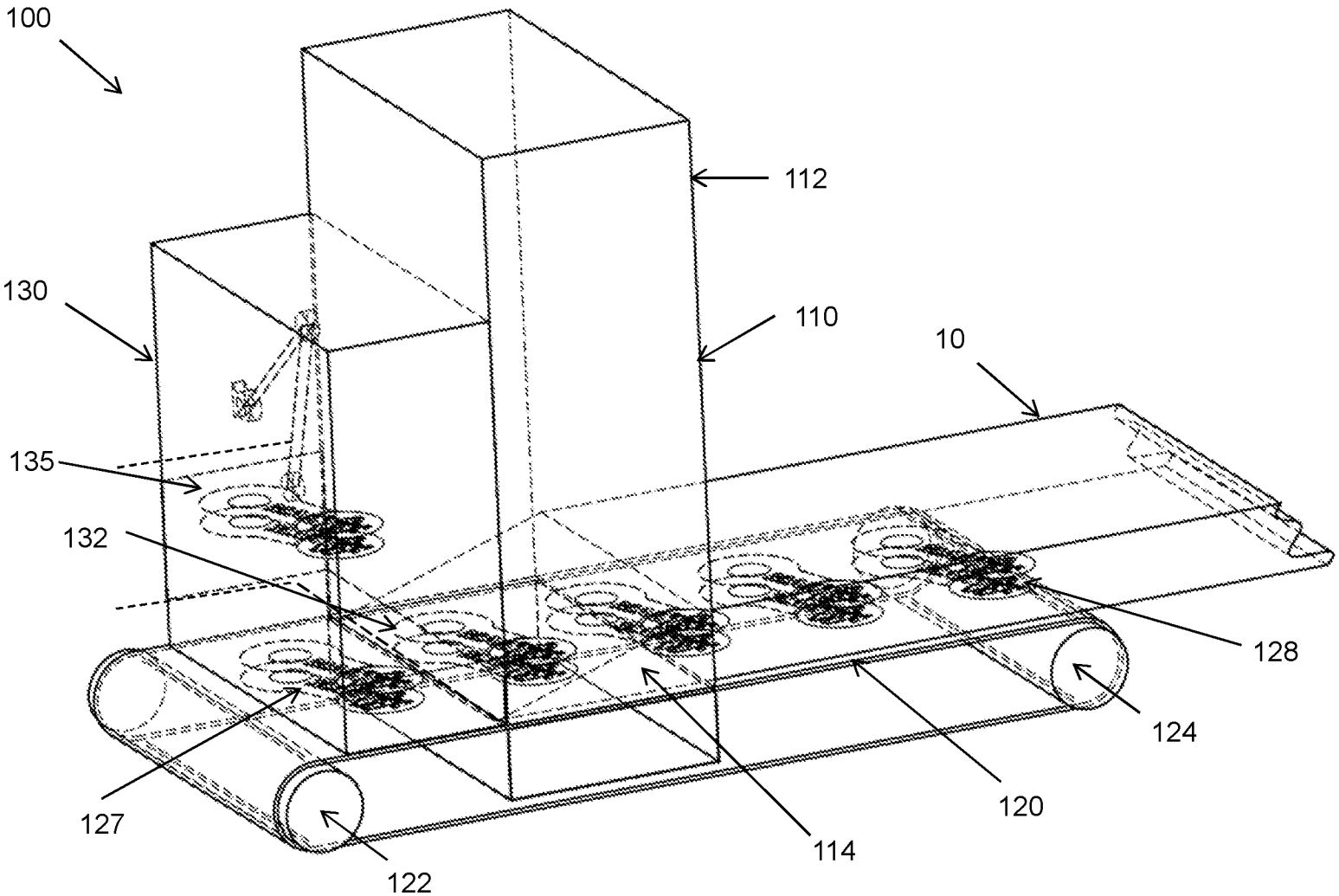
FIG. 17 is a schematic illustration of the apparatus for producing an air-laid blank in FIG. 16 during operation.

Another embodiment of a method of producing an air-laid blank 10 is schematically shown in the flow chart of FIG. 13, see also FIGS. 16 and 17. This method comprises introducing, in step S30, natural fibers and a thermoplastic polymer binder and/or a mixture of the natural fibers and the thermoplastic polymer binder into an upper end 112 of a forming head 110. This step corresponds to step S1 in FIG. 4 and is not further described herein.

In a next step S31, the natural fibers and the thermoplastic polymer binder and/or the mixture thereof is transported to a lower end 114 of the forming head 110 arranged in connection with a belt collector 120 running between drive rollers 122, 124. The method also comprises positioning, in step S32, a 3D object 127 onto the belt collector 120 and capturing, in step S33, the natural fibers and the thermoplastic polymer binder and/or the mixture thereof on the belt collector 120. The method further comprises heating, in step S34, the natural fibers and the thermoplastic polymer binder and/or the mixture thereof to form an air-laid blank 10. This step S34 corresponds to step S4 in FIG. 4 and is not further described herein.

According to the invention, the air-laid blank 10 comprises the natural fibers at a concentration of at least 70% by weight of the air-laid blank 10 and the thermoplastic polymer binder at a concentration selected within an interval of from 2.5 up to 30% by weight of the air-laid blank 10. The produced air-laid blank 10 has two parallel major surfaces 12, 14, see FIG. 3, and a thickness between the two parallel major surfaces 12, 14. The 3D object 127 defines an aperture 17 in a first major surface 14 of the two parallel major surfaces 12, 14 and a cavity 13 in the air-laid blank 10.

In an embodiment, the two parallel major surfaces 12, 14 are two parallel planar major surfaces 12, 14.

The air-laid blank 10 as produced in accordance with the method as shown in the flow chart of FIG. 13 comprises at least one cavity 13 with an aperture 17 and that is formed and created by the presence of the 3D object 127 on the belt collector 120. Thus, the 3D object 127 locally obstructs the natural fibers and the thermoplastic polymer binder mixture from being present in the portion of the air-laid blank 10 occupied by the 3D object 127.

The 3D object 127 can thereby be used to create cavities 13 in the air-laid blank 10. For instance, such a cavity 13 could be defined to match an article to be protected by the 3D shaped product 20. Hence, 3D objects 127 having a selected shape could be used to create cavities 13 in the air-laid blank 10 and thereby in the 3D shaped product 20 produced from the air-laid blank 10. The method as shown in FIG. 13 thereby enables production of air-laid blanks 10 with cavities 13 shaped and thereby adapted to goods and articles to be protected from shocks and/or thermally protected.

The cavity 13 comprises an aperture or opening 17 in a first major surface 14 of the air-laid blank 10. The cavity 13 preferably extends a portion of the thickness of the air-laid blank 10 from the first major surface 14 to the second major surface 12. In such embodiments, the cavity 13 thereby does not extend through the whole thickness of the air-laid blank 10. In other embodiments, the cavity 13 may in fact comprise a first aperture 17 in the first major surface 14 and a second aperture (not shown) in the second major surface 12, i.e., extends through the whole thickness of the air-laid blank 10.

Generally, more complexed cavities 13 can be produced in the air-laid blank 10 in accordance with the method disclosed in the flow chart of FIG. 13 as compared to hot pressing cavities using a male tool into the air-laid blank 10. This means that the cavities 13 in the air-laid blank 10 can have fairly complex geometries and shapes that are well adapted to the shape of any goods to be protected by the 3D shaped product 20 produced in the hot pressing of the air-laid blank 10.

In an embodiment, any portion 11 of the air-laid blank 10 aligned with the cavity 13 in the direction through the thickness of the air-laid blank 10 has a density different from the average density of the air-laid blank 10 as schematically shown in FIG. 3. In such an embodiment, the belt collector 120 is preferably an air-permeable belt collector 120 over which a vacuum is applied as previously described herein. The 3D object 127 is preferably at least partly air-permeable.

Figure 14:
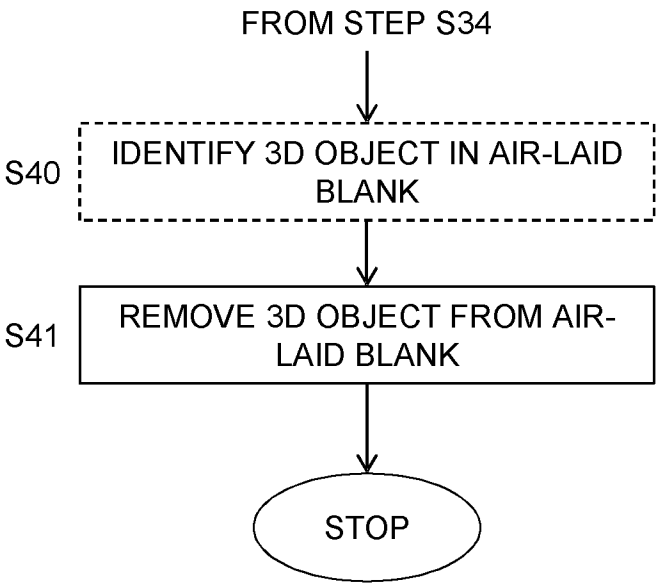
FIG. 14 is a flow chart illustrating additional, optional steps of the method shown in FIG. 13.

The air-laid blank 10 as output from the apparatus 100 in FIG. 17 may comprise the 3D object 127. Hence, the 3D object 127 is then contained in the air-laid blank 10 and is thereby surrounded by the mixture of natural fibers and thermoplastic polymer binders. In such an embodiment, the method may comprise an additional step S41 as shown in FIG. 14. The method continues from step S34 in FIG. 13. Step S41 comprises removing the 3D object 127 from the air-laid blank 10. This step S41 may involve manually removing the 3D object 127 from the air-laid blank 10 as output from the apparatus 100. Alternatively, a robot or other machine could remove the 3D object 127 from the air-laid blank 10 to thereby get an air-laid blank 10 with a cavity 13.

In an embodiment, the 3D object 127 comprises a tracking device 128. In such an embodiment, the method comprises an additional step S40 as shown in FIG. 14. This step S40 comprises identifying the 3D object 127 in the air-laid blank 10 based on the tracking device 128. The method then continues to step S41, where the identified 3D object 127 is removed from the air-laid blank 10.

Various types of tracking devices 128 could be used in order to identify the 3D object 127 in the air-laid blank 10. For instance, the tracking device 128 could comprise a magnet or be made of, or comprise, a material that is magnetic. In such a case, the tracking device 128 and thereby the 3D object 127 could be identified in the air-laid blank 10 using a magnet or a device that measures or responds to the magnetism of the magnet in the 3D object 127. Another solution is to have a tracking device 128 in the form of a radio frequency identification (RFID) tag or a near-field communication (NFC) device that is capable of wireless communicating with an external probe or device used to identify the tracking device 128 and the 3D object 127 in the air-laid blank 10. A further alternative is to use an inductive sensor that could be used to detect metal objects. In such a case, the 3D object 127 could be made of or at least comprise a metal material. The above described embodiments of tracking devices 128 should merely be seen as illustrative, but non-limiting, examples of tracking devices 128 that could be used to identify 3D objects 127 in the air-laid blank 10.

The 3D object 127 could be made of various materials including, but not limited to, plastics, polymers, metals, including metal alloys, etc.

Figure 15:
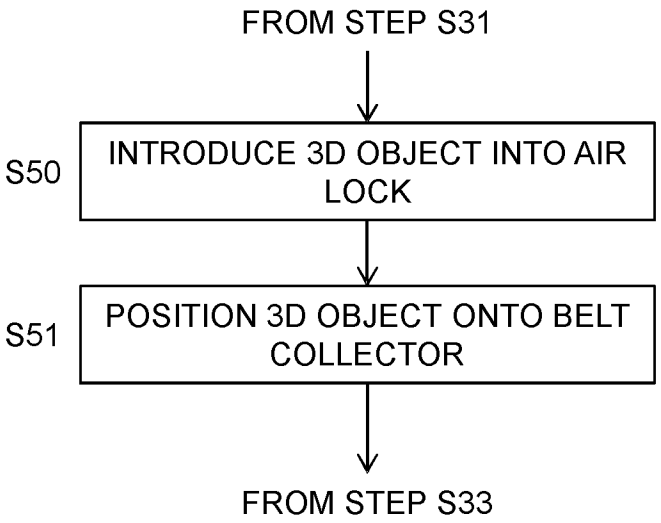
FIG. 15 is a flow chart illustrating additional, optional steps of the method shown in FIG. 13.

FIG. 15 is a flow chart illustrating an embodiment of step S32 in FIG. 13. The method continues from step S31 in FIG. 13. A next step S50 comprises introducing the 3D object 127 into an air lock 135 of a positioning head or chamber 130 arranged upstream of the forming head 110 but connected to the forming head 110 at least through a transport opening 132. This embodiment also comprises positioning, in step S51, the 3D object 127 onto the belt collector 120 inside the positioning head 130.

Hence, the 3D object 127 is preferably positioned on the belt collector 120 upstream of the forming head 110 and inside the positioning head 130 arranged upstream of the forming head 110 in the apparatus 100 but connected to the forming head 110 through the transport opening 132. This transport opening 132 thereby enables the 3D object 127 positioned on the belt collector 120 to be transported from the positioning head 130 into the forming head 110.

In an embodiment, the belt collector 120 is an air-permeable belt collector 120 as previously described herein with a vacuum applied over the air-permeable belt collector 120 to draw the natural fibers and thermoplastic polymer binder and/or the mixture thereof from the upper end 112 of the forming head 110 towards the lower end 114 and onto the air-permeable belt collector 120. In such a case, the positioning head 130 preferably comprises or is connected to an air lock 135 through which the 3D object 127 is introduced into the forming head 130. If no such air lock 135 is used for introducing the 3D object 127 into the positioning head 130, the opening of any opening in the positioning head 130 would negatively affect the vacuum-driven transport of the natural fibers and thermoplastic polymer binder and/or the mixture thereof through the forming head 110. The air lock 135 thereby enables introducing 3D objects 127 into the positioning head 130 without any significant negative effects on the vacuum-driven transport of the natural fibers and thermoplastic polymer binder and/or the mixture thereof through the forming head 110.

Figure 6:
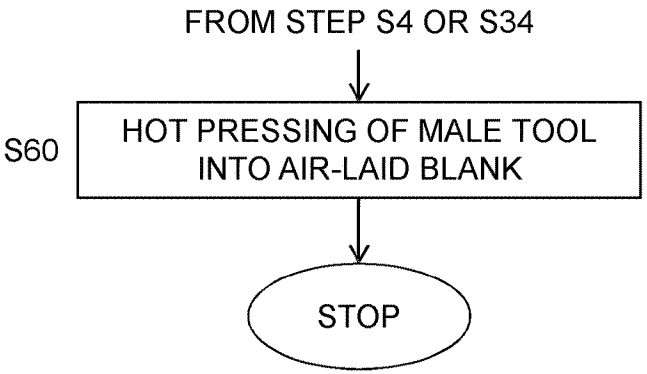
FIG. 6 is a flow chart illustrating an additional, optional step of the method shown in FIG. 4 or 13.

In an embodiment, the method as shown in FIG. 4 and/or the method as shown in FIG. 13 may comprise an additional step S60 as shown in FIG. 6. The resulting method, i.e., steps S1 to S4 and S60, or steps S30 to S34 and S60, thereby defines a method of producing a 3D shaped product 20. In such a case, the method continues from step S4 in FIG. 4 or from step S34 in FIG. 13. A next step S60 comprises hot pressing of a male tool 30 into the air-laid blank 10 to form a 3D shaped product 20 having a 3D shape at least partly defined by the male tool 30. The male tool 30 comprises a protrusion 31 configured to be pressed into the air-laid blank 10 and the protrusion 31 is configured to be aligned with the portion 11 of the air-laid blank 10 having a density different from the average density of the air-laid blank 10 during the hot pressing.

In an embodiment, the method of producing a 3D shaped product 20 thereby comprises, see FIGS. 4, 6, 7 and 17, introducing, in step S1, natural fibers and a thermoplastic polymer binder and/or a mixture of the natural fibers and the thermoplastic polymer binder into an upper end 112 of a forming head 110. The method also comprises transporting, in step S2, the natural fibers and the thermoplastic polymer binder and/or the mixture to a lower end 114 of the forming head 110 by vacuum applied over an air-permeable collector 120 arranged in connection with the lower end 114 of the forming head 110. The method further comprising capturing, in step S3, the natural fibers and the thermoplastic polymer binder and/or the mixture on the air-permeable collector 120 and heating, in step S4, the natural fibers and the thermoplastic polymer binder and/or the mixture to form an air-laid blank 10. The method additionally comprises hot pressing, in step S60, of a male tool 30 into the air-laid blank 10 to form a 3D shaped product 20 having a 3D shape at least partly defined by the male tool 30. In this embodiment, the air-laid blank 10 comprises the natural fibers at a concentration of at least 70% by weight of the air-laid blank 10 and the thermoplastic polymer binder at a concentration selected within an interval of from 2.5 up to 30% by weight of the air-laid blank 10. The air-laid blank 10 has an average density and a portion 11 of the air-laid blank 10 has a density different from the average density. The male tool 30 comprises a protrusion 31 configured to be pressed into the air-laid blank 10 and the protrusion 31 is configured to be aligned with the portion 11 of the air-laid blank 10 having a density different from the average density of the air-laid blank 10 during the hot pressing. Furthermore, the air-permeable collector 120 has an average air-permeability. In this embodiment, a portion 121 of the air-permeable collector 120 has an air-permeability different from the average air-permeability, and/or an object 125 is positioned on a portion 121 of the air-permeable collector 120. The portion 121 of the air-permeable collector 120 with the object 125 positioned thereon has an air-permeability different from the average air-permeability. A portion 11 of the air-laid blank 10 aligned with the portion 121 of the air-permeable collector 120 has a density different from the average density. In addition, the air-laid blank 10 has two parallel planar major surfaces 12, 14.

In another embodiment, the method of producing a 3D shaped product 20 thereby comprises, see FIGS. 6, 13 and 17, introducing, in step S30, natural fibers and a thermoplastic polymer binder and/or a mixture of the natural fibers and the thermoplastic polymer binder into an upper end 112 of a forming head 110. The method also comprises transporting, in step S31, the natural fibers and the thermoplastic polymer binder and/or the mixture to a lower end 114 of the forming head 110 arranged in connection with a belt collector 120 running between drive rollers 122, 124. The method further comprises positioning, in step S32, a 3D object 127 onto the belt collector 120 and capturing, in step S33, the natural fibers and the thermoplastic polymer binder and/or the mixture on the belt collector 120. The method additionally comprises heating, in step S34, the natural fibers and the thermoplastic polymer binder and/or the mixture to form an air-laid blank 10. The method also comprises hot pressing, in step S60, of a male tool 30 into the air-laid blank 10 to form a 3D shaped product 20 having a 3D shape at least partly defined by the male tool 30. In this embodiment, the air-laid blank 10 comprises the natural fibers at a concentration of at least 70% by weight of the air-laid blank 10 and the thermoplastic polymer binder at a concentration selected within an interval of from 2.5 up to 30% by weight of the air-laid blank 10. The air-laid blank 10 has an average density and a portion 11 of the air-laid blank 10 has a density different from the average density. The male tool 30 comprises a protrusion 31 configured to be pressed into the air-laid blank 10 and the protrusion 31 is configured to be aligned with the portion 11 of the air-laid blank 10 having a density different from the average density of the air-laid blank 10 during the hot pressing. Furthermore, the air-laid blank 10 has two parallel major surfaces 12, 14 and a thickness between the two parallel major surfaces 12, 14. The 3D object 127 defines an aperture 17 in a first major surface 14 of the two parallel major surfaces 12, 14 and a cavity 13 in the air-laid blank 10 and the portion 11 of the air-laid blank 10 aligned with the cavity 13 has a density different from the average density of the air-laid blank 10.

In an embodiment, step S60 in FIG. 6 comprises hot pressing of the male tool 30 into the air-laid blank 10 by hot pressing the portion 11 of the air-laid blank 10 harder than other portions 15 of the air-laid blank 10 that the male tool 30 engages.

This step S60 in FIG. 6 basically corresponds to step S20 in FIG. 12. The various embodiments of step S20 as described in the foregoing also apply to step S60 in FIG. 6.

Figure 18:
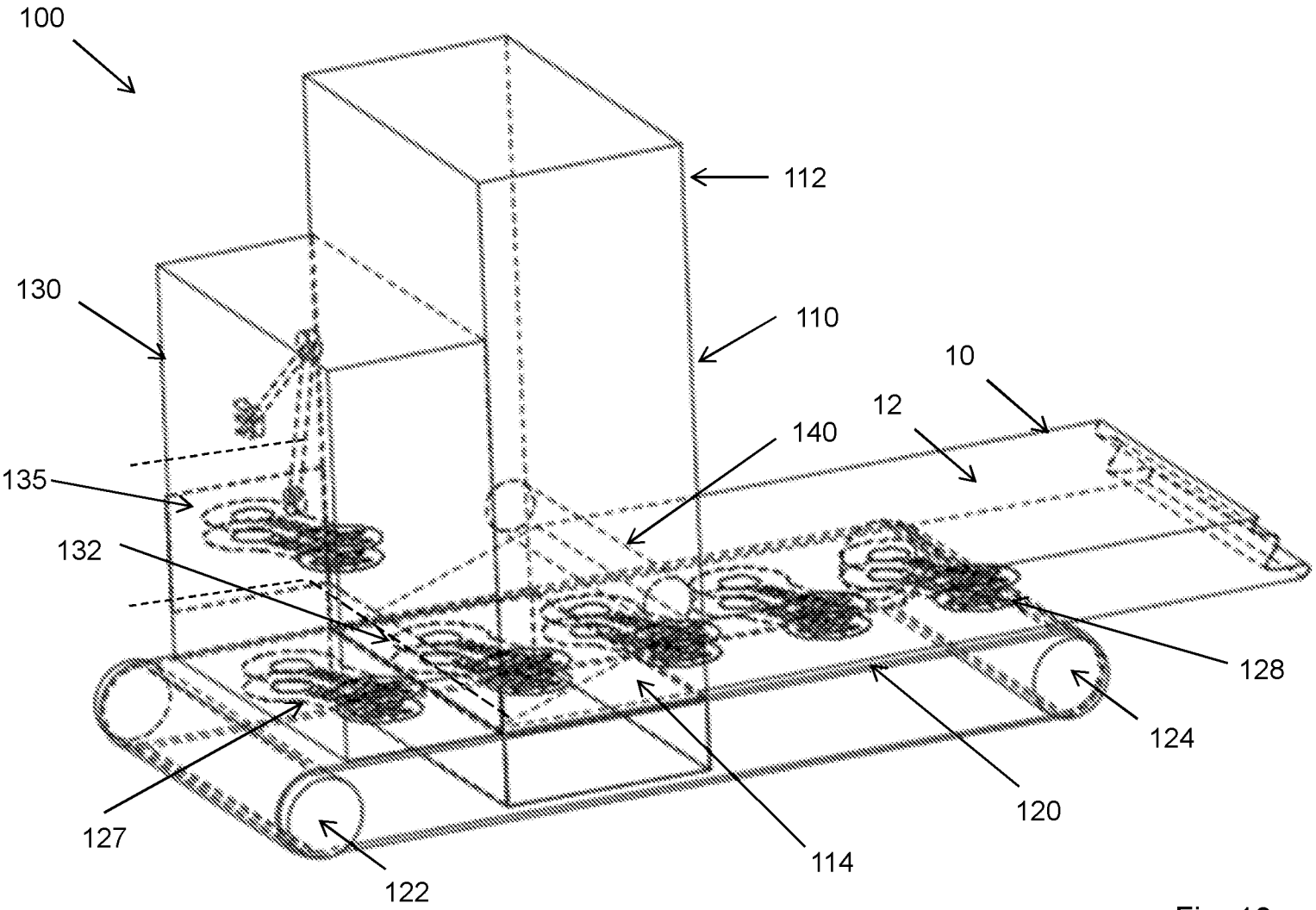
FIG. 18 is a schematic illustration of an apparatus for producing an air-laid blank according to a further embodiment.

In an embodiment, the methods as described above in connection with FIGS. 4-6 and 13-15 may comprise an additional step of smoothing the upper major surface 12 of the air-laid blank 10. In such an embodiment, the apparatus 100 for producing an air-laid blank 10 preferably comprises a device, tool or equipment 140 for smoothing the upper major surface 12 of the air-laid blank 10 as shown in FIG. 18. This device, tool or equipment 140 may be in the form of a brush or scraper arranged to remove any loose fibers from the upper major surface 12 and smoothing the surface 12 to be planar and smooth. The device, tool or equipment 140 is advantageously arranged downstream of the forming head 110 and thereby engages the upper major surface 12 of the air-laid blank 10 as it is output from the forming head 110. In an alternative embodiment, the device tool or equipment 140 could be arranged inside in the forming head 110 but is then preferably arranged close to or at the downstream exit of the forming head 110 where the air-laid blank 10 is output from the forming head 110. This device, tool or equipment 140 could also be arranged at the apparatus 100 as shown in FIG. 7.

The embodiments described above are to be understood as a few illustrative examples of the present invention. It will be understood by those skilled in the art that various modifications, combinations and changes may be made to the embodiments without departing from the scope of the present invention. In particular, different part solutions in the different embodiments can be combined in other configurations, where technically possible.

The invention claimed is:

1. An air-laid blank comprising:

natural fibers at a concentration of at least 70% by weight of the air-laid blank; and a thermoplastic polymer binder at a concentration selected within an interval of from 2.5 up to 30% by weight of the air-laid blank, wherein the air-laid blank has an average density, wherein the average density is selected within an interval of from 10 up to 60 kg/m$^3$;

wherein a portion of the air-laid blank has a density equal to 95% or less of the average density prior to exposing the air-laid blank to any compression;

wherein the air-laid blank has two parallel planar major surfaces;

wherein the portion of the air-laid blank with a density different from the average density has a two-dimensional extension parallel with the two parallel planar major surfaces and extends through an entire thickness of the air-laid blank.

2. The air-laid blank according to claim 1, wherein the portion of the air-laid blank has a density equal to or less than 75% of the average density.

3. The air-laid blank according to claim 1, wherein the natural fibers are wood fibers.

4. The air-laid blank according to claim 3, wherein the natural fibers are in a form selected from a group consisting of: sulfate pulp, sulfite pulp, thermomechanical pulp (TMP), high temperature thermomechanical pulp (HTMP), medium density fiberboard fiber (MDF-fiber), chemi-thermomechanical pulp (CTMP), high temperature chemi-thermomechanical pulp (HTCTMP), and a combination thereof.

5. The air-laid blank according to claim 1, wherein the thermoplastic polymer binder is selected from a group consisting of: a thermoplastic polymer powder, thermoplastic polymer fibers, and a combination thereof.

6. The air-laid blank according to claim 1, wherein the thermoplastic polymer binder is made from i) a material selected from a group consisting of: polyethylene (PE), ethylene acrylic acid copolymer (EAA), ethylene-vinyl acetate (EVA), polypropylene (PP), polystyrene (PS), polybutylene adipate terephthalate (PBAT), polybutylene succinate (PBS), polylactic acid (PLA), polyethylene terephthalate (PET), polycaprolactone (PCL), copolymers thereof and mixtures thereof, and ii) optionally one or more additives.

7. The air-laid blank according to claim 1, wherein the portion of the air-laid blank with a density equal to 95% or less of the average density has a density selected within an interval of from 1 to 50 kg/m$^3$.

8. The air-laid blank according to claim 1, wherein the air-laid blank has a uniform thickness.

9. An air-laid blank comprising:

natural fibers at a concentration of at least 70% by weight of the air-laid blank; and a thermoplastic polymer binder at a concentration selected within an interval of from 2.5 up to 30% by weight of the air-laid blank, wherein the air-laid blank has an average density;

wherein a portion of the air-laid blank has a density equal to 95% or less of the average density prior to exposing the air-laid blank to any compression;

wherein the air-laid blank has two parallel planar major surfaces;

wherein the air-laid blank comprises a cavity extending into but not through an entire thickness of the air-laid blank; and wherein the portion of the air-laid blank with a density different from the average density is aligned with the cavity.

10. The air-laid blank according to claim 9, wherein the natural fibers are wood fibers.

11. The air-laid blank according to claim 10, wherein the natural fibers are in a form selected from a group consisting of: sulfate pulp, sulfite pulp, thermomechanical pulp (TMP), high temperature thermomechanical pulp (HTMP), medium density fiberboard fiber (MDF-fiber), chemi-thermomechanical pulp (CTMP), high temperature chemi-thermomechanical pulp (HTCTMP), and a combination thereof.

12. The air-laid blank according to claim 9, wherein the thermoplastic polymer binder is selected from a group consisting of: a thermoplastic polymer powder, thermoplastic polymer fibers, and a combination thereof.

13. The air-laid blank according to claim 9, wherein the thermoplastic polymer binder is made from i) a material selected from a group consisting of: polyethylene (PE), ethylene acrylic acid copolymer (EAA), ethylene-vinyl acetate (EVA), polypropylene (PP), polystyrene (PS), polybutylene adipate terephthalate (PBAT), polybutylene succinate (PBS), polylactic acid (PLA), polyethylene terephthalate (PET), polycaprolactone (PCL), copolymers thereof and mixtures thereof, and ii) optionally one or more additives.

14. The air-laid blank according to claim 9, wherein the average density is selected within an interval of from 10 up to 60 kg/m$^3$, or wherein the portion of the air-laid blank with a density equal to 95% or less of the average density has a density selected within an interval of from 1 to 50 kg/m$^3$, or both.

15. The air-laid blank according to claim 9, wherein the density of the portion of the air-laid blank with a density equal to 95% or less of the average density increases or decreases when travelling through a thickness of the air-laid blank from one of the two parallel planar major surfaces to the other of the two parallel planar major surfaces.

* * * * *